United States Patent [19]

Schubert et al.

[11] 4,036,119

[45] July 19, 1977

[54] METHOD AND MACHINE FOR THE PRODUCTION OF COMPOSITE FILTER MOUTHPIECES

[75] Inventors: Bernhard Schubert, New Bornsen; Otto Blidung, Geesthacht, both of Germany

[73] Assignee: Hauni-Werke Körber & Co., KG, Hamburg, Germany

[21] Appl. No.: 656,712

[22] Filed: Feb. 9, 1976

Related U.S. Application Data

[62] Division of Ser. No. 483,668, June 27, 1974, Pat. No. 3,961,633, which is a division of Ser. No. 275,096, July 25, 1972, Pat. No. 3,834,285.

[30] Foreign Application Priority Data

| | | |
|---|---|---|
| July 26, 1971 | Germany | 2137318 |
| July 26, 1971 | Germany | 2137319 |
| Sept. 10, 1971 | Germany | 2145375 |

[51] Int. Cl.[2] ..... A24C 5/50

[52] U.S. Cl. ..... 93/77 FT

[58] Field of Search ..... 93/1 C, 77 FT; 131/261 R

[56] References Cited

U.S. PATENT DOCUMENTS

| | | | |
|---|---|---|---|
| 3,357,320 | 12/1967 | Sexstone et al. | 93/1 C |
| 3,517,480 | 6/1970 | Pinkham | 93/1 C X |
| 3,757,649 | 9/1973 | Labbe | 93/1 C |
| 3,854,384 | 12/1974 | Naylor | 93/77 FT X |

*Primary Examiner*—James F. Coan
*Attorney, Agent, or Firm*—Peter K. Kontler; John Kurucz

[57] ABSTRACT

Filter mouthpieces with one or more thin filter disks consisting of a first filter material and one or more filter plugs consisting of a second filter material are produced by inserting filter disks between spaced-apart filter plugs which form a single file and travel with a web of wrapping material. The web is thereupon draped around the alternating filter disks and filter plugs to form therewith a continuous filter rod which is severed to yield discrete filter mouthpieces.

14 Claims, 15 Drawing Figures

METHOD AND MACHINE FOR THE PRODUCTION OF COMPOSITE FILTER MOUTHPIECES

CROSS-REFERENCE TO RELATED CASES

This is a division of our copending application Ser. No. 483,688 filed June 27, 1974 now U.S. Pat. No. 3,961,633. The application Ser. No. 483,668 is a division of Ser. No. 275,096 filed July 25, 1972, now U.S. Pat. No. 3,834,285 granted Sept. 10, 1974.

BACKGROUND OF THE INVENTION

The present invention relates to a method and machine for the making of composite filter mouthpieces for cigarettes, cigars or cigarillos. More particularly, the invention relates to improvements in a method and machine for the manufacture of composite filter mouthpieces wherein a tubular envelope contains different types of filter material. Still more particularly, the invention relates to improvements in a method and machine for the production of filter mouthpieces wherein a tubular envelope contains one or more cylindrical plugs or wads and one or more disk-shaped elements of gas-permeable filter material and wherein the material of the filter plug or plugs is normally different from the material of the filter disk or disks.

It is already known to provide cigarettes, cigars and/or cigarillos with composite filter mouthpieces which contain two or more different filter materials. It was found that a composite mouthpiece is often a more effective means for segregating from tobacco smoke substantial quantities of nicotine, tar and/or other deleterious ingredients. For example, it is known to employ filter mouthpieces wherein a tube contains a wad or plug of acetate fibers and a charge of granular filter material, e.g., activated carbon. It is also known to replace the charges of granular or powdery material with thin disk-shaped filters which consist of glass fibers alone or glass fibers impregnated with one or more chemicals. The relatively thin glass fiber disks are surprisingly effective as concerns their ability to absorb various harmful ingredients of tobacco smoke. However, such filter elements exhibit the serious drawback that they are much more difficult to assemble with other components, especially when the filter mouthpieces are to be produced at the rate of several thousand per minute. The problems in connection with the manipulation of relatively thin disk-shaped filters are attributed mainly to the small length of such filter elements as well as to the fact that they are readily deformable. As a rule, the material of filter disks is quite soft so that they are likely to be deformed to an extent which renders them useless in composite filter mouthpieces for cigarettes or the like. The problems in connection with the manipulation of filter disks are equally severe when the filter mouthpieces are to be assembled in the form of continuous filter rods which are thereupon subdivided into filter mouthpieces of desired length, when the components of filter mouthpieces are inserted into tubular envelopes which travel sideways, as well as when the filter mouthpieces are assembled and immediately attached to tobacco rod sections which constitute plain cigarettes, cigars or cigarillos.

SUMMARY OF THE INVENTION

An object of the invention is to provide a novel and improved method of producing composite filter mouthpieces which contain one or more disk-shaped filter elements according to which the assembly of filter mouthpieces can be completed at a high rate of speed, with a high degree of reproducibility and without any damage to or deformation of sensitive disk-shaped filter elements.

Another object of the invention is to provide a novel and improved method of producing discrete filter mouthpieces which contain one or more disk-shaped filter elements.

A further object of the invention is to provide a novel and improved method of producing a continuous filter rod which can be subdivided into filter mouthpieces of unit length or multiple unit length and each mouthpiece of which contains at least one disk-shaped filter element.

A further object of the invention is to provide a novel and improved machine for the production of a continuous filter rod which can be subdivided into mouthpieces having one or more disk-shaped filter elements.

Another object of the invention is to provide a machine for the making and/or processing of filter mouthpieces having one or more disk-shaped filter elements which is constructed and assembled in such a way that it can turn out large quantities of mouthpieces per unit of time without, however, affecting the quality, appearance and/or integrity of filter disks.

An additional object of the invention is to provide the improved machine with novel and improved means for producing and/or manipulating disk-shaped filter elements for use in composite filter mouthpieces which contain several types of filter material.

Still another object of the invention is to provide a machine for the making of filter mouthpieces containing one or more disk-shaped filter elements which can provide such mouthpieces with minimal waste in filter material and which can assemble filter mouthpieces at the rate necessary to meet the requirements of a modern high-speed filter cigarette making or like machine.

One feature of the invention resides in the provision of a method of making composite filter mouthpieces each of which comprises at least one disk-shaped filter element and at least two plug or wad-shaped filter elements. The method comprises the steps of moving a continuous web of wrapping material lengthwise, placing onto or against one side of the moving web a single file of axially spaced filter plugs and moving the filter plugs with the web, placing filter disks between successive filter plugs of the file and moving the filter disks with the web and filter plugs, draping the web around the filter plugs and filter disks to form an elongated filter rod wherein filter disks alternate with filter plugs, and severing the filter rod to form a plurality of discrete filter mouthpieces each of which contains at least one filter disk and at least a portion of at least two filter plugs.

The second placing step may comprise holding each of the filter disks at one side or one axial end thereof and positioning each of the thus held filter disks in abutment with one of the adjacent filter plugs. The draping step preferably further comprises connecting the filter disks with the abutting filter plugs by means of the web of wrapping material which can have its one side at least partially coated with a layer of adhesive material. At least one of the placing steps may comprise moving the respective filter elements (particularly the filter disks) sideways against the one side of the moving web of wrapping material. The filter disks are preferably held by suction during transport into the spaces between the filter plugs at one side of the moving web of wrapping material.

The method may further comprise the step of moving the filter disks between the filter plugs axially so that each of the thus moved filter disks abuts against one of the adjacent filter plugs, or moving the filter plugs of the single file axially so that each of the thus moved filter plugs abuts against a discrete filter disk.

Still further, the method may comprise the step of holding the filter disks in abutment with the adjacent filter plugs at one side of the moving web, at least prior to the draping step or even during the initial stage of the draping step, to thus insure that the filter disks are not moved away from the abutting filter plugs or vice versa. The just mentioned holding step may comprise attracting the filter disks against the abutting filter plugs by suction which acts through the abutting filter plugs. The placing of filter plugs against one side of the moving web may be carried out at least substantially simultaneously with the placing of filter disks.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 14 is an axial sectional view of a filter cigarette of unit length which is manufactured in the machine of FIG. 11.

DESCRIPTION OF THE PREFERRED EMBODIMENTS

Figure 1:
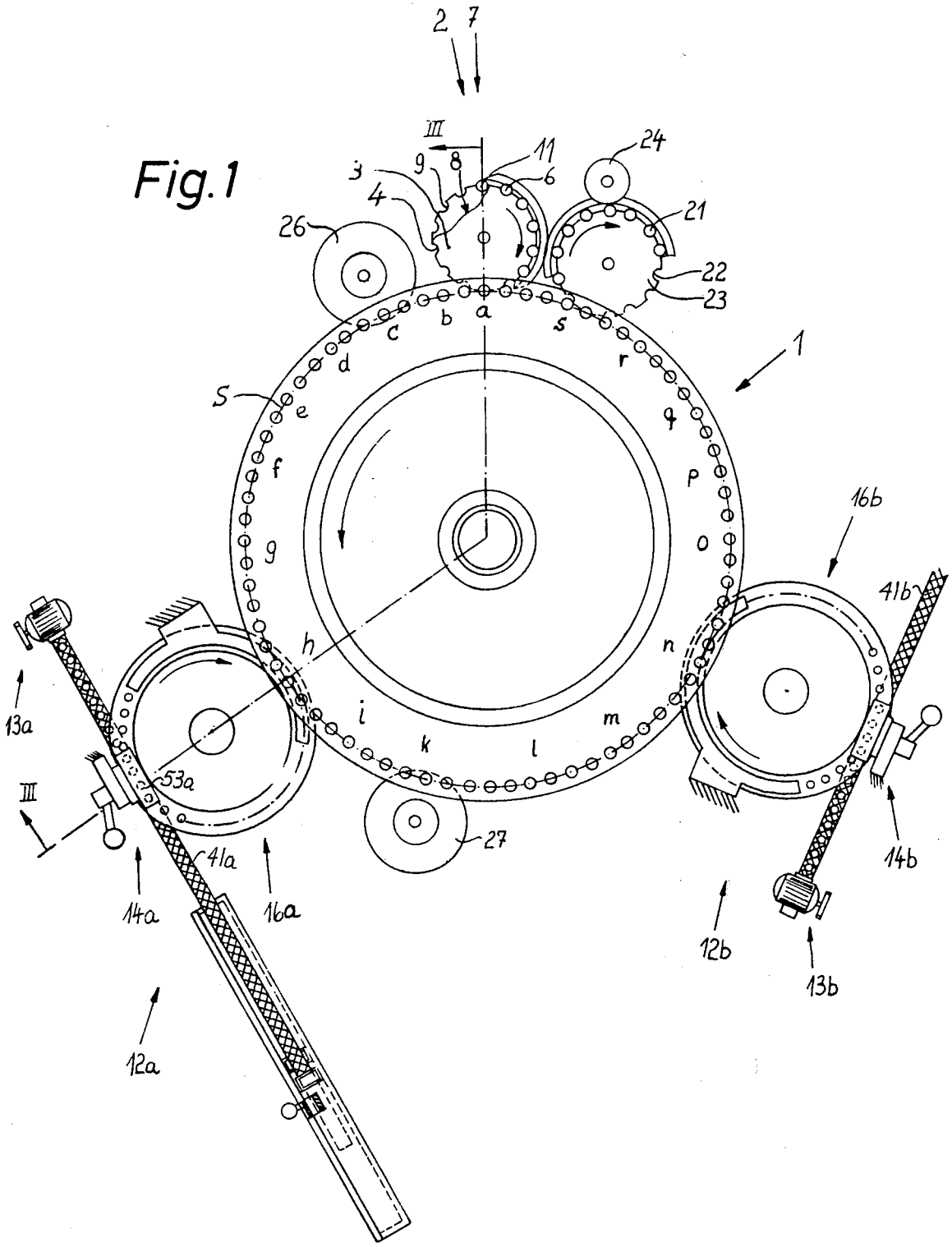
FIG. 1 is a schematic plan view of a machine for the making of composite filter mouthpieces of double unit length which embodies one form of the invention.

FIG. 1 illustrates a filter mouthpiece making machine which comprises a first feeding unit 2 including a continuously rotating drum-shaped conveyor 3 which is rotatable about a vertical axis and has axially parallel peripheral flutes 4 for reception and transport of filter rod sections 6. The machine further comprises a second feeding unit 7 including a continuously rotating drum-shaped conveyor 8 having axially parallel flutes 9 for prefabricated tubes 11. A third feeding unit 12*a* comprises an advancing device 13*a* for a strip or tape 41*a* (see also FIG. 2) of filter material which is caused to travel past a stamping or filter disk forming device 14*a*. The device 14*a* comprises tools 52*a* (FIG. 2) which serve to remove from the strip 41*a* filter disks 19. Such disks are accepted by a transfer conveyor 16*a* which delivers them to an assembly conveyor system 1. The transfer conveyor 16*a* comprises a perforated or apertured disk 17*a* with recesses, bores or analogous receptacles 18*a* for the filter disks 19. Still further, the machine comprises a second filter disk feeding unit 12*b* which is preferably identical with the feeding unit 12*a* and whose parts are denoted by similar reference numerals but with the letter *a* behind each numeral replaced by the letter *b*. Thus, the feeding unit 12*b* comprises an advancing device 13*b*, a stamping or filter disk forming device 14*b* which has tools 52*b* serving to remove filter disks 19 from a second strip 41*b*, and a transfer conveyor 16*b* having a disk 17*b* with receptacles 18*b* for the disks 19. The filter mouthpieces 21 of double unit length which are assembled on the conveyor system 1 are accepted by a continuously rotating take-off conveyor 23 having axially parallel flutes 22 for the mouthpieces 21. The flutes 22 of the conveyor 23 transport successive filter mouthpieces 21 past a continuously rotating heating device 24 whose purpose is described in U.S. Pat. No. 3,603,058 granted Sept. 7, 1971 to Schubert. The conveyor system 1 comprises means for transporting the filter rod sections 6 past two angularly spaced rotary disk-shaped knives 26, 27 which sever the filter rod sections 6 to subdivide the latter into filter plugs or wads of desired length. The planes of the knives 26, 27 are normal to the axes of the filter rod sections 6 which are held to move sideways. The path along which the prefabricated tubes 11, filter rod sections 6, their filter plugs and the filter disks 19 travel with the conveyor system 1 is shown in FIG. 1, as at S. This path extends along the transfer stations between the conveyor system 1 and the conveyors 3, 8, 16*a*, 16*b* and 23. The means for supplying tubes 11 to the conveyor 8 and for supplying filter rod sections 6 to the conveyor 3 is not shown in the drawing; such supplying means may comprise conical conveyors of the type shown in FIG. 12 of U.S. Pat. No. 3,603,058 to Schubert and serving to withdraw tubes and filter rod sections from suitable magazines.

Figure 2:
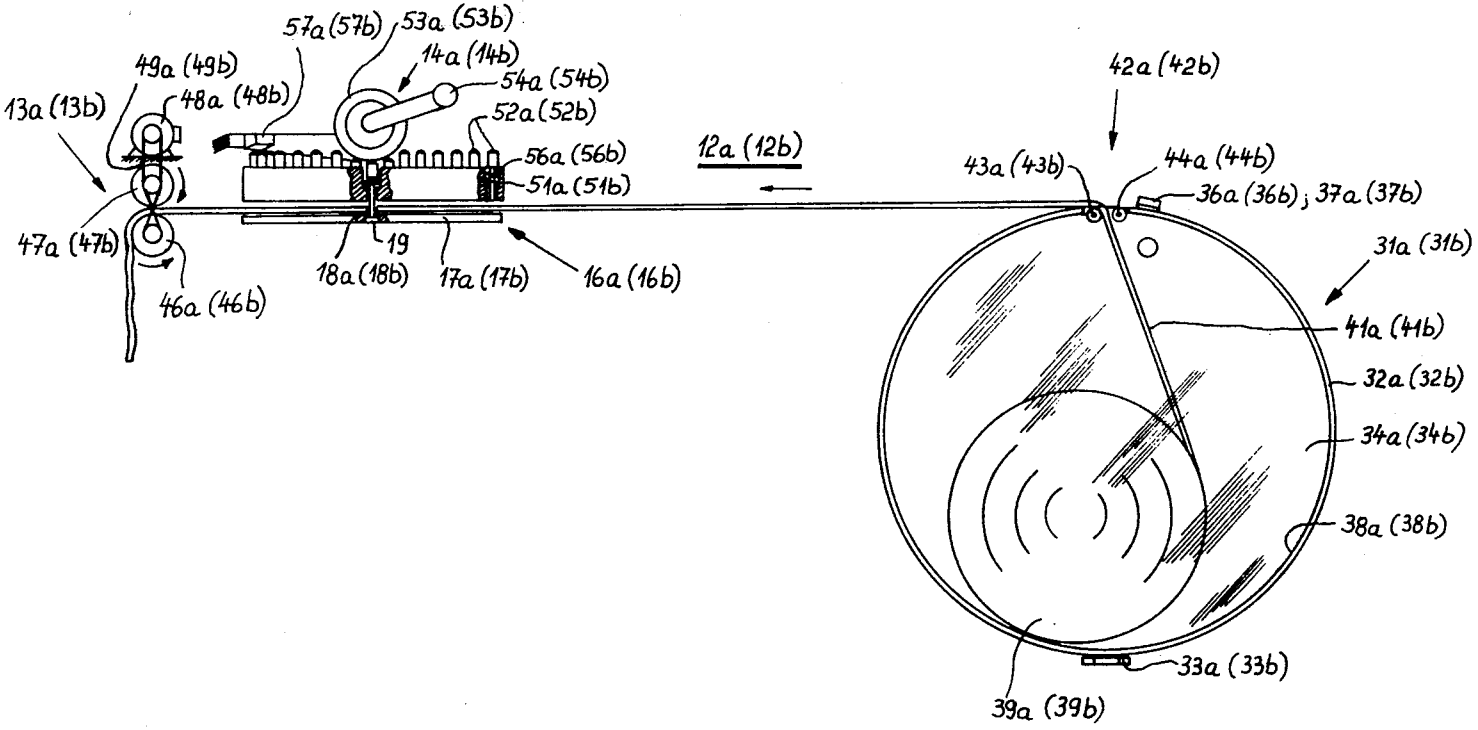
FIG. 2 is an enlarged side elevational view of a filter disk forming and feeding unit in the machine of FIG. 1.

The component parts of the feeding unit 12*a* or 12*b* are shown in FIG. 2. Since the two feeding units are identical, only the unit 12*a* will be described in detail; the reference numerals (shown in parentheses) followed by letter *b* refer to component parts of the feeding unit 12*b*.

The feeding unit 12*a* comprises the component parts which were mentioned in connection with the description of FIG. 1 and a container 31*a* which confines a bobbin 39*a* of convoluted filter material or strip 41*a*. When a fresh bobbin 39*a* is inserted into the container 31*a*, the leading end of such bobbin is introduced into the nip of two advancing rolls 46*a*, 47*a* which constitute the advancing device 13*a*. The container 31*a* comprises a cylindrical portion or wall 32*a* of relatively short axial length, a first disk-shaped end wall fixed to one axial end of the cylindrical wall 32*a*, and a second end wall 34*a* which preferably consists of a transparent synthetic plastic material (such as plexiglass) and is pivotally mounted at the other axial end of the cylindrical wall 32*a* by means of a hinge 33*a* or the like. The light transmitting end wall 34*a* is normally held in the illustrated operative position by two magnets 36*a*, 37*a*. The internal surface 38*a* of the cylindrical wall 32*a* serves as an endless track for the bobbin 39*a* in the container 31*a*. The two end walls of the container 31*a* hold the bobbin 39*a* against excessive axial movement during withdrawal of the strip 41*a*. The cylindrical wall 32 has an axially parallel outlet opening or mouth 42*a* which is flanked by two idler rolls 43*a*, 44*a* and serves to permit withdrawal of the strip 41*a* in response to rotation of the advancing rolls 46*a*, 47*a*. The advancing rolls 46*a*, 47*a* are constantly driven by an electric motor 48*a* by way of a V-belt 49*a*.

The stamping or filter disk forming device 14*a* comprises a rotary wheel-shaped carrier 51*a* for at least one annulus of reciprocable stamping tools 52*a*. The carrier 51*a* is disposed between the container 31*a* and the advancing rolls 46*a*, 47*a*. Each tool 52*a* resembles a pin one end of which is formed with a circular cutting edge adjacent to the path of movement of the strip 41*a* toward the advancing device 13*a*. The tools 52*a* are biased upwardly, as viewed in FIG. 2, by springs 56*a* and travel seriatim below the outer race of a relatively large antifriction bearing 53*a* which is mounted at a level directly above the path for the strip 41*a* and can be adjusted up or down by means of a lever 54*a*. The selected position of the bearing 53*a* is such that it causes successive tools 52*a* on the continuously rotating carrier 52*a* to move downwardly while they overlie the path for the strip 41*a* and to thereby remove from the strip filter disks 19 each of which has a diameter equalling or very closely approaching that of a filter rod section 6. The axial length of the outer race of the bearing 53*a* is preferably selected in such a way (see also FIG. 1) that it can move downwardly two or more tools 52*a* at a time in order to allow for simultaneous formation of several filter disks 19 as well as to allow for utilization of the material of the strip 41*a* with minimal waste. As shown in FIG. 1, the tools 52*a* need not remove a straight row of filter disks 19 but can be located at different distances from the axis of the carrier 51*a* to form in the strip 41*a* a series of holes or cutouts in a so-called quincunx formation. A receptacle 18*a* of the disk 17*a* of the transfer conveyor 16*a* registers with that stamping tool 52*a* which is caused to perform a working stroke in response to movement below the outer race of the bearing 53*a*. Thus, the freshly formed filter disks 19 are introduced into and remain in the registering receptacles 18*a* for transport to the path S defined by the conveyor system 1. The stamping device 14*a* further comprises a stationary guide cam 57*a* which determines the extent to which the tools 52 rise under the action of their springs 56*a* or descend during certain stages of orbital movement about the axis of the carrier 51*a*. The manner in which the bottom face of the guide cam 57*a* is inclined is illustrated in FIG. 3*b*.

Figure 3A:
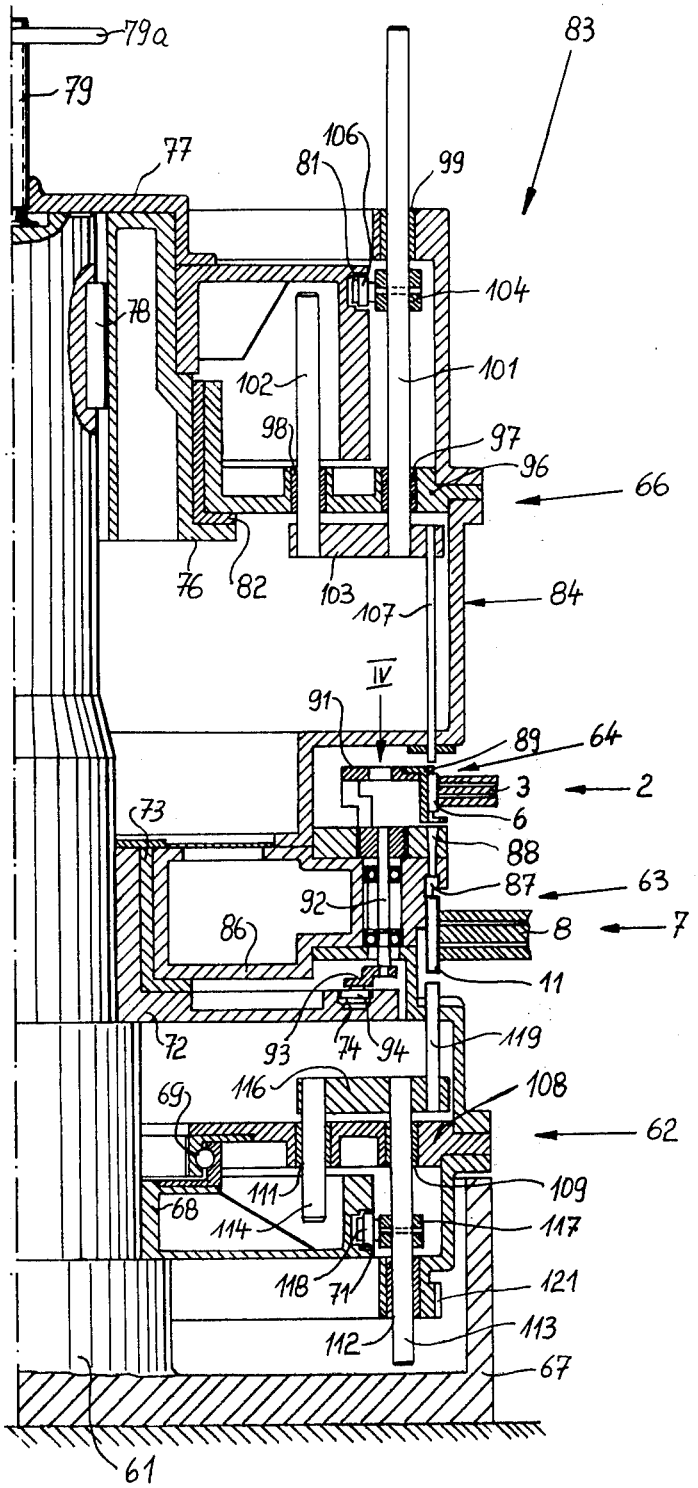
FIG. 3 (composed of FIGS. 3*a* and 3*b*) is an enlarged vertical sectional view as seen in the direction of arrows from the line III—III of FIG. 1.
Figure 3B:
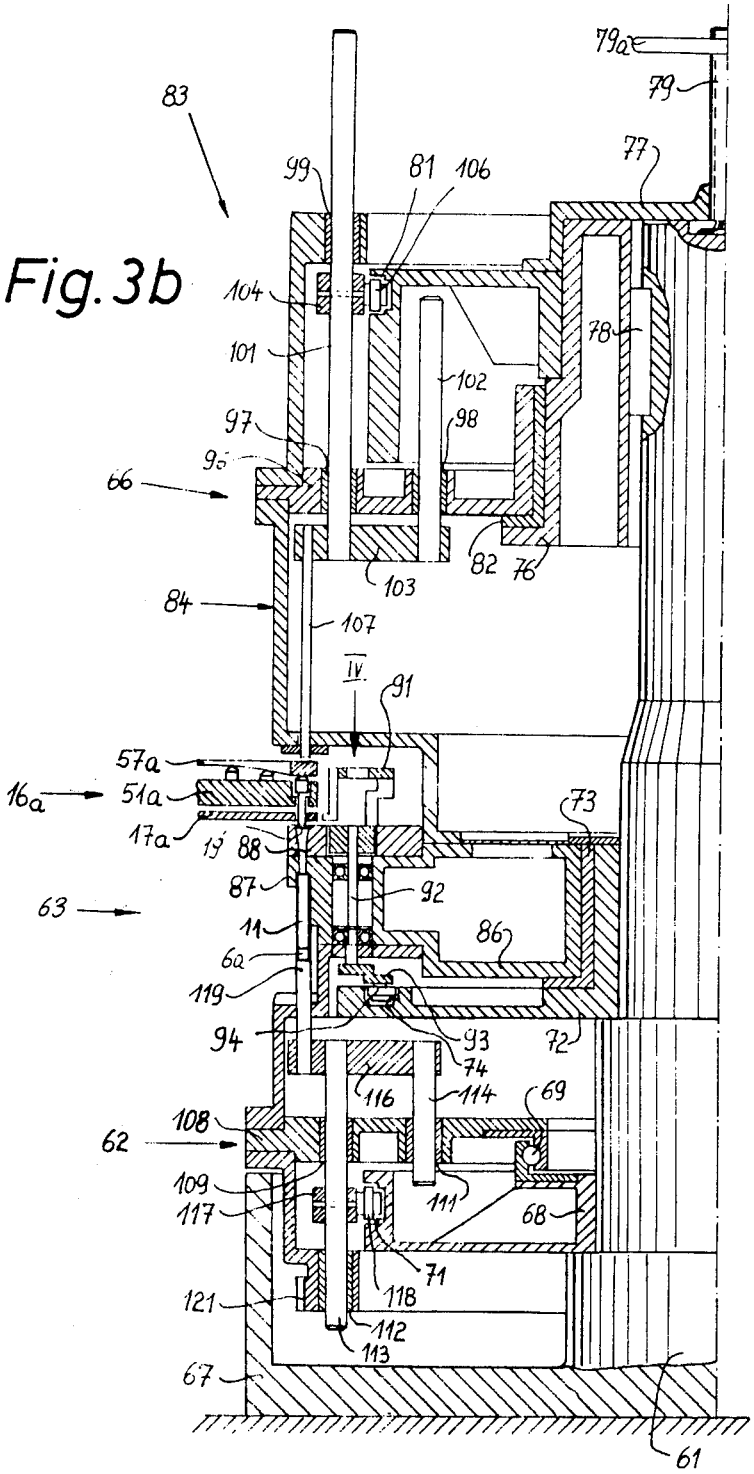

FIGS. 3*a* and 3*b* together illustrate the details of the conveyor system 1. This system comprises a centrally located upright column 61 which rotatably supports a conveyor 62 for axially movable plungers 119, a conveyor 63 for tubes 11, a conveyor 64 for filter rod sections 6, and a conveyor 66 for plug- and disk-introducing transfer members or rams 107. The conveyor 63 receives tubes 11 from the conveyor 8 of the feeding unit 7, and the conveyor 64 receives filter rod sections 6 from the conveyor 3 of the feeding unit 2. FIG. 3*b* further shows a portion of the transfer conveyor 16*a* for filter disks 19 which are formed in the feeding unit 12*a*.

The column 61 is mounted in a stationary frame 67 and has close to its bottom end a circumferential shoulder for an annular support 68 which carries an antifriction bearing 69. The outer race of the bearing 69 is threadedly or otherwise connected to the support 68. The support 68 comprises a cylindrical outermost portion 71 which has an external surface provided with a circumferentially complete cam groove for roller followers 118. The portion 71 is coaxial with the column 61 and bearing 69. The roller followers 118 form part of the conveyor 62 for plungers 119.

A second support 72 rests on a second annular shoulder of the column 61 at a level above the support 68 and is surrounded by a sleeve bearing 73. The support 72 also comprises a cylindrical outermost portion 74 the upper surface of which is provided with an endless cam groove for roller followers 94. The roller followers 94 transmit motion to holders 89 for the filter rod sections 6. The holders 89 form part of the conveyor 64.

A third support 76 has a top end wall 77 which rests on the upper end face of the column 61. One or more keys 78 are provided to hold the support 76 against rotation on the column 61. The end wall 77 of the support 76 meshes with a feed screw 79 which is provided with a handwheel 79*a* and abuts against the upper end face of the column 61. By rotating the feed screw 79, the operator can raise or lower the entire support 76 by moving it in the axial direction of the column 61. The support 76 is rigid or integral with a cylindrical drive cam 81 which is provided with an external circumferential cam groove for roller followers 106 serving to transmit motion to the rams 107 of the conveyor 66. The support 76 further carries a bearing sleeve 82. The supports 68, 72 cannot rotate relative to the column 61, the same as the support 76.

Figure 4:
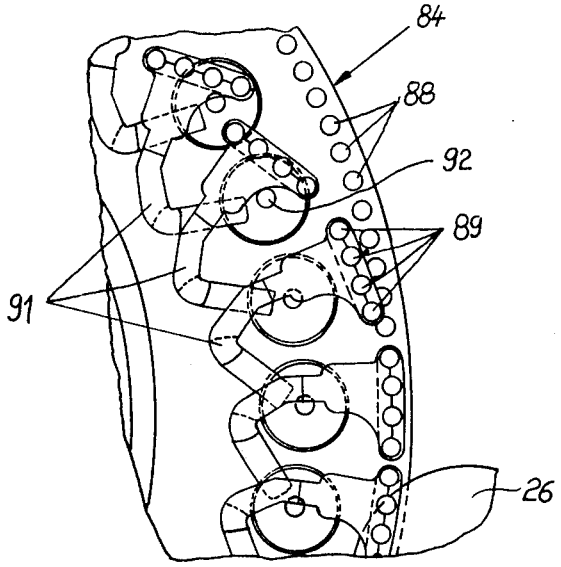
FIG. 4 is an enlarged fragmentary plan view of a detail as seen in the direction of arrow IV shown in FIG. 3*a* or 3*b;*

The bearings 69, 73, 82 rotatably support a cylindrical body 83 which constitutes a part of the conveyor 66, a part of the conveyor 63, a part of the conveyor 64, and a part of the conveyor 62. The body 83 comprises a hollow tubular housing 84 which is assembled of several interconnected portions. The portion 86 of the housing 84 forms part of the conveyor 64 and is located immediately above a horizontal flange of the bearing 73 and is rotatable on this bearing. The periphery of the housing portion 86 is formed with equidistant axially parallel receptacles 87 for tubes 11. Each receptacle 87 comprises a grooved lower portion and a ring-shaped upper portion. The upper portion of each receptacle 87 registers with a vertical bore 88 whose diameter increases upwardly and which terminates at the level of the rotary knives 26 and 27. As shown in FIGS. 3*a*, 3*b* and 4, the conveyor 64 for the filter rod sections 6 comprises a plurality of holders 89 which are mounted at a level slightly above the upper ends of the bores 88. Each holder 89 resembles one of the receptacles 87, i.e., it comprises a grooved upper portion and a lower portion forming a ring. Groups or sets of four holders 89 for filter rod section 6 are mounted on discrete levers 91 which are pivotable about the axes of vertical shafts 92 mounted in the housing portion 86. The lower end portion of each shaft 92 carries an arm 93 for a roller follower 94 which, as mentioned above, extends into the cam groove in the top face of the stationary drive cam 74 forming part of the support 72. Thus, as the housing portion 86 rotates about the axis of the column 61, the cam 74 controls the pivotal movements of levers 91 about the axes of the respective shafts 92. This enables the holders 89 and the filter rod sections 6 therein to move into and from axial alignment with the receptacles 87 for the tubes 11.

The upper portion of the housing 84 supports a guide ring 96 which is threadedly connected thereto and surrounds the cylindrical portion of the bearing 82. The guide ring 96 is provided with pairs of vertical bores 97, 98 whose axes are located in planes including the axis of the column 61. The angular distance between the planes of neighboring pairs of bores 97, 98 equals that between the first, fifth, ninth, etc. receptacles 87. Each of the bores 97 is in axial alignment with a further bore 99 located at a level above the guide ring 96 and provided in the upper end portion of the housing 84. Each bore 97 and the aligned bore 99 receives a vertical guide rod 101, and each bore 98 receives a vertical guide rod 102. The lower end portions of each pair of associated guide rods 101, 102 carry supporting arms 103 for groups or sets of four rams 107.

Each guide rod 101 carries a block 104 which is located between the respective bores 97, 99 and carries the shaft of a roller follower 106 extending into the circumferential groove of the aforementioned drive cam 81. The groups or sets of rams 107 extend downwardly from the respective supporting arms 103 and each thereof registers with a receptacle 87. It will be noted that the drive cam 81 serves to effect movements of the rams 107 toward and away from the aligned receptacles 87 whereby the rams 107 can shift the filter rod sections 6 which are received in the holders 89 which such holders register with the respective receptacles 87. As mentioned above, the movements of levers 91 for the holders 89 are controlled by the drive cam 74.

The lower portion of the housing 84 receives a guide ring 108 which is secured to one race of the bearing 69 and is threadedly connected to the housing 84. The guide ring 108 is formed with equidistant pairs of vertical bores 109, 111 whose distribution is the same as that of the bores 97, 98 in the upper guide ring 96. Each bore 109 is in axial alignment with a bore 112 provided in the lower end portion of the housing 84. The bores 109 and the aligned bores 112 receive guide rods 113, and the bores 111 receive guide rods 114. The pairs of guide rods 113, 114 carry at their upper ends supporting arms 116 for groups or sets of four plungers 119 each of which registers with a receptacle 87 for tubes 11. Each guide rod 113 is provided with a block 117 for a roller follower 118 which extends into the circumferential groove of the drive cam 71. The latter constitutes a means for moving the plungers 119 up or down during certain stages of angular movement of the housing 84 about the axis of the column 61. The lower end portion of the housing 84 is formed with a ring gear 121 which is driven by a pinion (not shown) receiving torque from the main prime mover of the machine.

FIG. 4 shows a portion of the rotary knife 26. It will be noted that this knife can sever groups or sets of four filter rod sections 6 while the filter rod sections are held in register with the adjacent receptacles 87. The manner in which the other knife 27 can sever the filter rod sections 6 is the same. FIG. 4 further shows that the levers 91 have suitably bent portions so that they do not interfere with each other during angular movement about the axes of the respective shafts 92.

Figure 6:
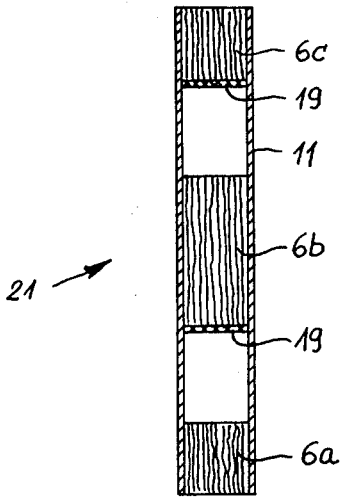
FIG. 6 is an enlarged axial sectional view of a filter mouthpiece which is manufactured in the machine of FIGS. 1 to 4.
Figure 5:
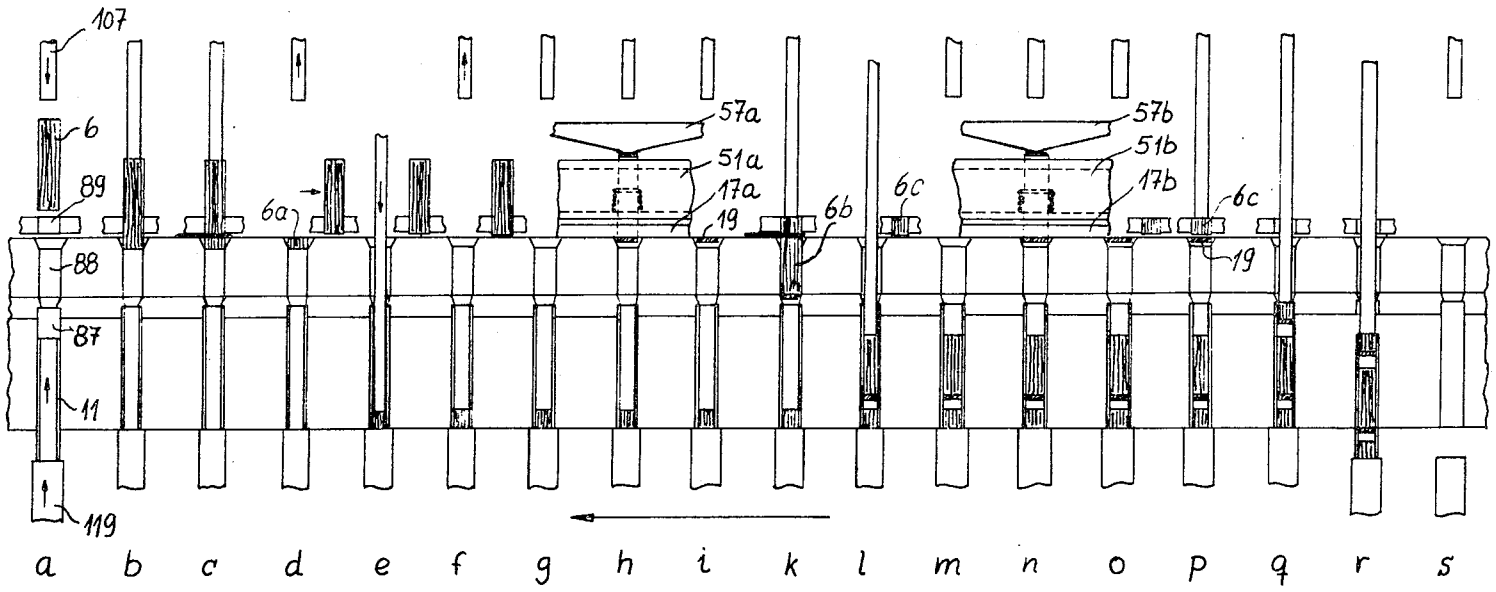
FIG. 5 is a developed view of a portion of the machine of FIGS. 1 to 4, showing the sequence of steps in the manufacture of a filter mouthpiece of double unit length.

FIG. 5 illustrates diagrammatically successive stations *a* to *s* for the making of filter mouthpieces 21 of double unit length of the type shown in FIG. 6. The stations *a* to *s* are further shown in FIG. 1 adjacent to the circle denoting the path S. The filter mouthpiece 21 of FIG. 6 is of double unit length and comprises a tube 11, a centrally located portion **6*b* of a filter rod section 6 (the portion 6*b* constitutes a filter plug or wad of double unit length), two portions 6*a*, 6*c* of a filter rod section 6 (the portions 6*a*, 6*c* constitute filter plugs or wads of unit length), and two filter disks 19. One of the disks 19 abuts against the inner end of the plug 6*c* and is axially spaced from the filter plug 6*b*, and the other filter disk 19 abuts against one end of the plug 6*b* and is axially spaced from the plug 6*a*. The outer ends of the filter plugs 6*a*, 6*c* are flush with the respective ends of the tube 11. The tube 11 may consist of paper or cardboard. The combined length of filter plugs 6*a*, 6*b*, 6*c* equals the length of a filter rod section 6, and these filter plugs may consist of acetate fibers. The filter disks 19 may consist of interlaced glass fibers. It was found that the filter mouthpiece 21 is more effective if its filter disk or disks abut against one of the filter plugs or if the filter disk abuts against the inner end of the tobacco rod section in a finished filter-tipped cigarette, cigarillo or cigar. Also, the mouthpiece is more effective if the filter disk is separated from one of the adjoining filter plugs by a clearance or gap such as those shown in FIG. 6 between the upper filter disk 19 and the filter plug 6*b* as well as between the lower filter disk 19 and the filter plug 6*a*.** This allows for expansion of filter disks during smoking of a filter-tipped cigarette, cigar or cigarillo.

The operation:

A common prime mover drives the conveyors 62, 63, 64, 66 of the conveyor system 1, the conveyors 3, 8, the tranfer conveyors **16*a*, 16*b*, and the conveyor 23 at a predetermined constant speed. The direction in which the conveyors are caused to rotate are indicated by arrows shown in FIG. 1.** At the station *a* of the path S, successive flutes 4 of the conveyor 3 in the feeding unit 2 deliver filter rod sections 6 into the holders 89 of the conveyor 64. At the same time, a flute 9 of the conveyor 8 in the feeding unit 7 delivers an empty tube 11 into the adjacent receptacle 87 of the conveyor 63. The conveyors 3 and 8 are suction conveyors, i.e., the filter rod sections 6 and the tubes 11 are held in their respective flutes 4 and 9 by suction during transport to the conveyors 64 and 63. Stationary retaining shrouds are provided to mechanically hold the filter rod sections 6 and tubes 11 immediately after delivery to the holders 89 and receptacles 87. As a pair of freshly delivered axially aligned components 6, 11 begin to move with the respective conveyors 64, 63, the corresponding guide rods 113, 114 are caused by the drive cam 71 to move upwardly and to thereby lift the respective supporting arm 116 which, in turn, lifts the corresponding set of four plungers 119. This causes the corresponding set of four tubes 11 to move upwardly into the ring-shaped upper portions of the respective receptacles 87. The plungers 119 thereupon maintain the tubes 11 in such raised positions until after completion of the respective filter mouthpieces 21 of double unit length. At the same time, the guide rods 101, 102 are caused to move downwardly under the action of the drive cam 81 so that the corresponding supporting arm 103 lowers the respective set of four rams 107. This causes four freshly admitted filter rod sections 6 to penetrate through the ring-shaped portions of the respective holders 89 and into the aligned bores 88 (see the station *b* in FIGS. 1 and 5). As the conveyor system 1 continues to turn, the four filter rod sections 6 move past and are severed by the rapidly rotating knife 26 so that each thereof yields a plug or wad 6a of unit length which remains in the aligned bore 88. The severing of filter rod sections 6 by the knife 26 takes place at the station *c*. the drive cam 81 thereupon causes the roller follower 106 for the just discussed set of rams 107 to rise and the corresponding lever 91 (with its four holders 89) is caused by the drive cam 74 to pivot about the axis of its shaft 92 so as to move the remainders of the respective filter rod sections 6 out of register with the adjacent bores 88 (see the station *d*). The rams 107 are thereupon caused by the cam 81 to descend so that they introduce the freshly severed filter plugs 6a into the aligned tubes 11 therebelow. This takes place at the station *e*. It will be noted that the cam 81 causes the rams 107 to move the plugs 6a into the lowermost portions of the respective tubes 11. The rams 107 are thereupon retracted during travel past the stations *f* and *g*.

In the meantime, the feeding unit 12a of FIGS. 1 and 2 operates to produce a succession of filter disks 19 in the following manner: The advancing device 13a draws the strip 41a off the bobbin 39a in the container 31a whereby the bobbin rolls along the cylindrical internal surface 38a of the wall 32a. The strip 41a is relatively narrow and is guided between the carrier 51a of the stamping device 14a and the apertured disk 17a of the transfer conveyor 16a whereby successive tools 52a of the carrier 51a remove from the strip 41a a succession of filter disks 19 while such tools travel below and are depressed by the outer race of the antifriction bearing 53a. The diameter of each filter disk 19 either very closely approximates or exactly matches the diameter of a filter rod section 6. The carrier 51a is driven by the prime mover so that the speed of its tools 52a equals the speed of lengthwise movement of the strip 41a. The freshly formed filter disks 19 are retained in the apertures 18a of the disk 17a which moves successive filled apertures 18a into register with successive bores 88. The configuration of the aforementioned guide cam 57a for the tools 52a is such that it causes a tool 52a which registers with the adjacent bore 88 to descend and to thus transfer the freshly stamped filter disk 19 from the aligned apertured 18a into the adjacent bore 88 of the conveyor 63.

The filter disks 19 which are supplied by the feeding unit 12a reach successive bores 88 of the conveyor 63 at the station *h*. The cam 74 thereupon causes the levers 91 to return the respective sets of holders 89 into alignment with the adjacent bores 88, and the cam 81 causes the ram 107 to descend and to push portions of the adjacent set of filter rod sections 6 into the aligned bores 88. This causes the disks 19 to penetrate into the bores 88 ahead of the respective filter rod sections 6. While travelling at the station *k*, the thus inserted filter rod sections 6 (each of which is minus the filter plug 6a) are severed by the knife 27 so that each thereof yields a filter plug 6b of double unit length which remains in the respective bore 88. The rams 107 are lifted by the cam 81 not later than at the station *k* to an extend which is necessary to allow for renewed pivotal movement of the respective lever 92 to move its holders 89 out of register with the adjacent bores 88 (each such holder 89 then supports only the plug 6c, i.e., one fourth of the original filter rod section 6). The cam 81 then causes the rams 107 to descend and to push the four filter plugs 6b therebelow into the aligned tubes 11 whereby the plugs 6b push the respective filter disks 19 in front of them (see the station *l*) to predetermned positions above the respective filter plugs 6a. The rams 107 are thereupon retracted by the cam 81 through the intermediary of the respective roller follower 106 (see the station *m*).

The feeding unit 12b forms and delivers a succession of filter disks 19 in the same way as described in connection with the feeding unit 12a. The filter disks 19 which are formed by the feeding unit 12b reach the bores 88 at the station *n* and are introduced into such bores by the respective tools 52b under the action of the guide cam 57b. In the next step, the cam 74 causes the respective lever 91 to return its four holders 89 into register with the adjacent bores 88 (see the station *p*) and the cam 81 moves the respective rams 107 downwardly to thus introduce the plugs 6c into the aligned tubes 11 by way of the respective bores 88. The plugs 6c push the filter disks 19 which are delivered by the feeding unit 12b and the extent of downward movement of rams 107 under the action of the cam 81 is such that the upper disks 19 are brought to a standstill at a predetermined distance from the upper ends of the respective filter plugs 6b of double unit length. Also, the upper end faces of the filter plugs 6c of unit length are flush with the upper end faces of the respective tubes 11 (see the station *q*).

The cam 81 thereupon causes the four rams 107 to descend still further and to expel the respective filter mouthpieces 21 from their receptacles 87. This is possible because the plungers 119 descend simultaneously with and at the same rate as the aligned rams 107 to insure the axial positions of plugs 6a and 6c in the mouthpieces 21 remain unchanged. The removal or mouthpieces 21 from the ring-shaped upper portions of the respective receptacles 87 is completed at the station *r*. Such mouthpieces are thereupon accepted by the flutes 22 of the conveyor 23 and are held by suction during transport to a further conveyor (not shown) which delivers the mouthpieces to storage, to a tray filling machine or directly into a filter cigarette making machine, not shown.

It will be noted that the machine of FIGS. 1 to 5 completes sets of four mouthpieces 21 at a time. However, it is clear that the machine can be readily modified to produce one, two, three, five or more mouthpieces at a time.

The machine of FIGS. 1 to 5 can be converted for the making of filter mouthpieces of unit length by using shorter tubes 11 and shorter filter rod sections 6 and by deleting or deactivating the feeding unit 12a or 12b and the knife 26 or 27. Analogously, the machine can be converted for the making of filter mouthpieces of more than two times unit length.

The rams 107 perform a number of functions including effecting axial displacements of filter rod sections 6 prior to severing of such sections by knives 26, 27, introduction of the thus obtained filter plugs *6a, 6b, 6c* into the aligned tubes 11, introduction of filter disks 19 into the tubes 11, and expulsion of finished filter mouthpieces 21 from the respective receptacles 87.

The mounting of sets of holders 89 on common levers 92 contributes to a higher output of the machine.

Figure 7:
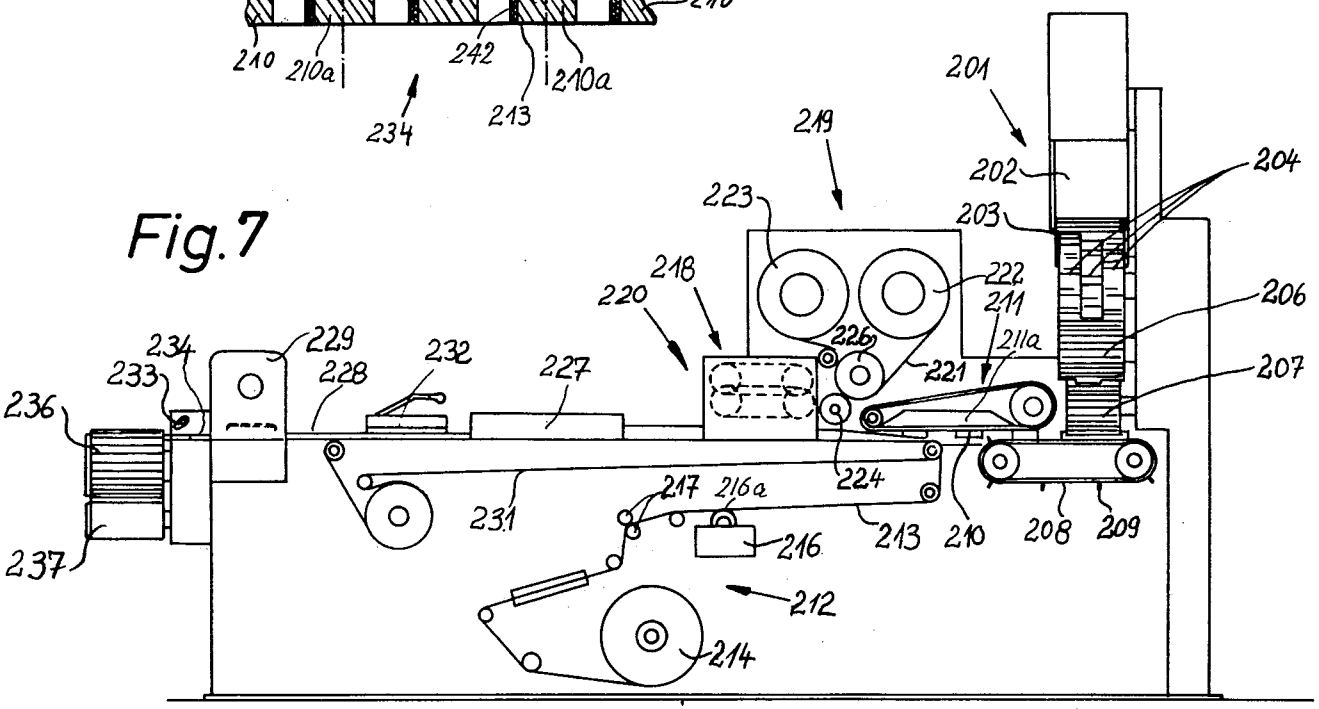
FIG. 7 is a side elevational view of a second filter mouthpiece making machine.

The machine of FIG. 7 comprises a feeding unit 201 which supplies filter plugs 210 of double unit length and comprises a magazine or hopper 202 for storage of a supply of parallel filter rod sections of several times (e.g., six times) unit length. The magazine 202 has an outlet which discharges filter rod sections into successive flutes of a rotary cutting conveyor 203 cooperating with two rotary disk-shaped knives (not shown) to subdivide succesive filter rod sections of six times unit length into filter plugs 210 of double unit length. The thus obtained three rows of filter plugs 210 are transferred onto three rotary staggering conveyors 204 which stagger the filter plugs 210 in such a way that the filter plugs form a single row of parallel but staggered filter elements which are transferred into successive flutes of an aligning conveyor 206 cooperating with one or more cams so as to convert the thus transferred row of filter plugs into a row wherein the filter plugs are located exactly one behind the other (see U.S. Pat. No. 3,164,242 to Schubert et al.). Successive filter plugs 210 are thereupon introduced into the flutes of a transfer conveyor 207 cooperating with an endless conveyor belt or chain 208 having equidistant transversely extending extraining elements or pushers 209 which remove filter plugs 210 from successive flutes of the transfer conveyor 207 and form a single file of axially aligned filter plugs which are taken over by the lower stretch of a foraminous conveyor belt 211 travelling below a stationary suction chamber 211*a*.

The parts 202–204 and 206–207 of the feeding unit 201 are analogous to those in the filter plug forming and feeding unit of filter cigarette making machines known as MAX and produced by the West German Firm of Hauni-Werke Korber & Co. K.G., of Hamburg-Bergedorf.

The machine of FIG. 7 further comprises a second feeding unit 212 which serves to supply a continuous web or tape 213 of paper, cork or other suitable wrapping material. The web 213 is withdrawn from a bobbin 214 by a pair of advancing rolls 217 and its underside is coated with adhesive by the rotary applicator 216*a* of a paster 216. The feeding unit 212 is similar to that which is used in filter rod making machines of the type known as KDF produced by Hauni-Werke of Hamburg-Bergedorf.

Figure 10:
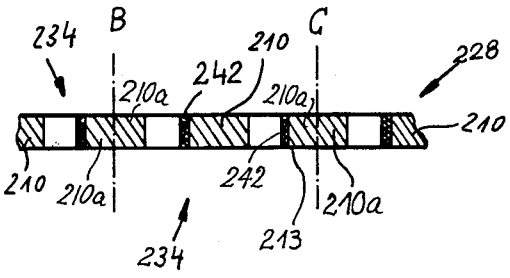
FIG. 10 is a fragmentary axial sectional view of a filter rod which is produced in the machine of FIGS. 7-9, further showing in axial section a complete filter mouthpiece of double unit length and a portion of such filter mouthpiece.
Figure 8:
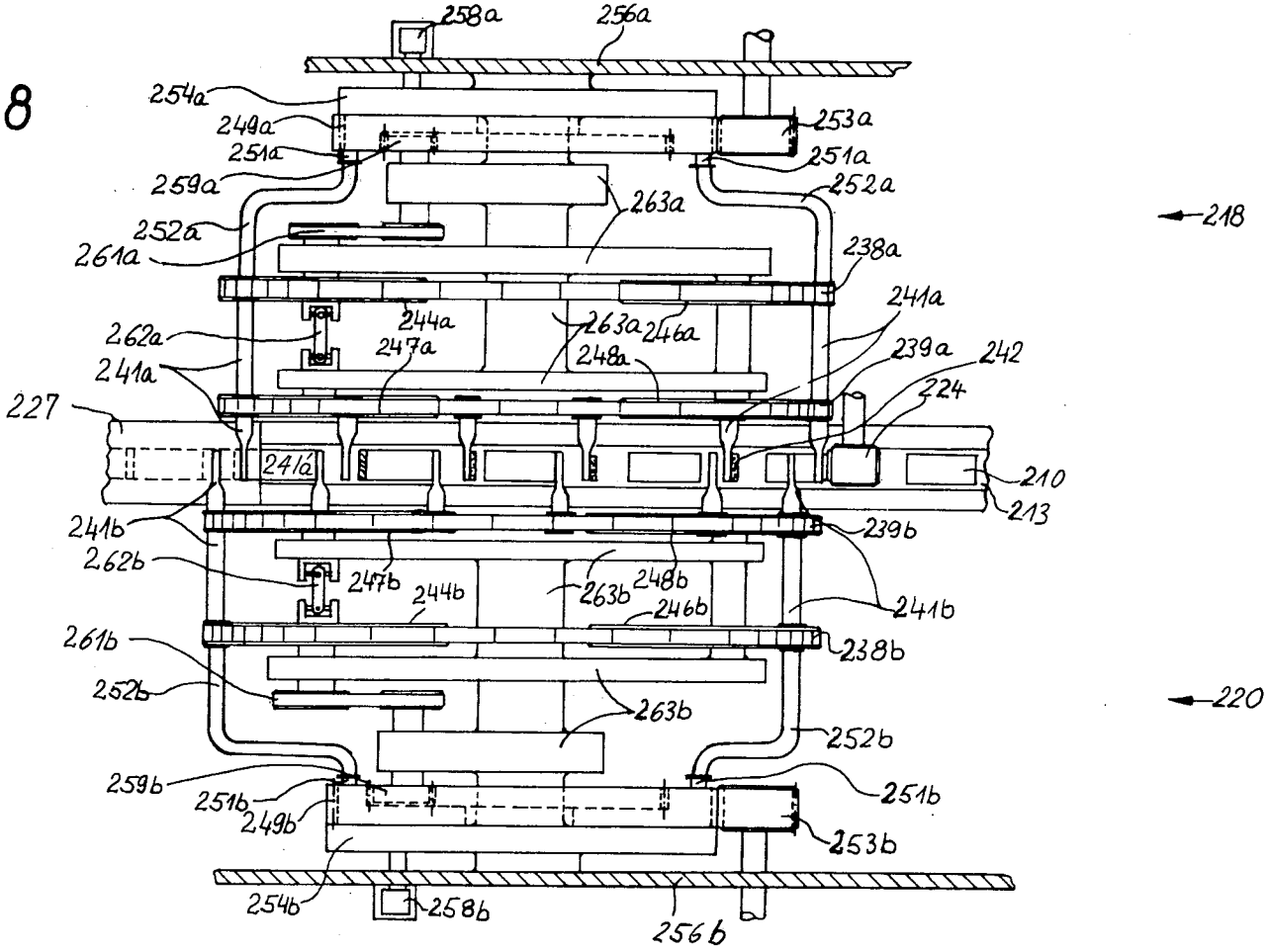
FIG. 8 is an enlarged plan view of two conveyors in the machine of FIG. 7.

A third feeding unit 219 of the machine shown in FIG. 7 serves to supply a succession of filter disks 242 shown in FIGS. 8 and 10. The feeding unit 219 comprises a roll 222 of convoluted filter material 221 which forms an elongated strip or tape and is collected by a takeup reel 223. The strip 221 is trained over a drum 226 which constitutes a counterknife or anvil and is located opposite a wheel-shaped rotary carrier 224 for discrete stamping tools. As the strip 221 travels from the roll 222 toward the takeup reel 223, the tools of the rotating carrier 224 remove therefrom at least one row of flat filter disks 242 which are transferred onto an inserting conveyor 218 best shown in FIGS. 8 and 9. The conveyor 218 cooperates with a plug shifting or displacing conveyor 220 also shown in detail in FIGS. 8 and 9.

The web 213 of wrapping material is fed onto the advances with the upper stretch of a garniture belt 231 which receives a single file of filter plugs 210 from the foraminous conveyor belt 211 and which also receives filter disks 242 from the conveyor 218. The plugs 210 and disks 242 are placed onto the adhesive-coated upper side of the web 213 on the upper stretch of the garniture belt 231. The latter moves the web 213 through a wrapping or draping mechanism 227 which drapes the web around the alternating plugs 210 and disks 242 to form an elongated filter rod 228. The filter rod 228 travels below a plate-like sealer 232 which heats the same formed by the overlapping marginal portions of the web 213, and thereupon through a conventional cutoff 229 which severs the rod 228 at regular intervals (see the phantom lines B and C in FIG. 10) to subdivide the rod 228 into discrete filter mouthpieces 234 of double unit length. The knife of the cutoff 229 severs each second filter plug 210 midway between its ends to that each mouthpiece 234 comprises a centrally located filter plug 210 of double unit length, two filter plugs 210*a* of unit length which are spaced apart from the opposite axial ends of the plug 210, and two filter disks 242 one of which abuts against one end of the filter plug 210 and the other of which abuts against one end of one of the filter plugs 210*a*. The distance between the filter plug 210 and the filter plugs 210*a* in each mouthpiece 234 exceeds the thickness of a filter disk 242 so that the left-hand filter disk 242 of the right-hand mouthpiece 234 shown in FIG. 10 is spaced apart from the left-hand plug 210*a* and the right-hand disk 242 of this mouthpiece is spaced apart from the respective filter plug 210.

The filter mouthpieces 234 which are separated by the cutoff 229 from filter rod 228 form a single file and move axially into the range of an accelerator 233 here shown as a rotary cam having one or more lobes which propel successive mouthpieces 234 into successive axially parallel flutes of a transfer conveyor 236. The latter moves the mouthpieces 234 sideways and delivers them onto the upper stretch of an endless belt conveyor 237 for transport into a filter cigarette making machine, such as the aforementioned MAX of Hauni-Werke.

The filter cigarette making machine is provided with means for placing successive mouthpieces 234 of double unit length between pairs of coaxial plain cigarettes of unit length and for thereupon convoluting an adhesive-coated uniting band around each mouthpiece 234 and around the adjacent ends of the respective plain cigarettes to form a series of filter cigarettes of double unit length. Each such cigarette is thereupon severed midway between its ends (across the filter plug 210 of the respective mouthpiece 234) to yield two filter cigarettes of unit length. The mouthpiece of each filter cigarette of unit length comprises two axially spaced filter plugs 210*a* of unit length and a single filter disk 242 which is disposed between the two plugs 210*a* and abuts against one thereof.

Figure 9:
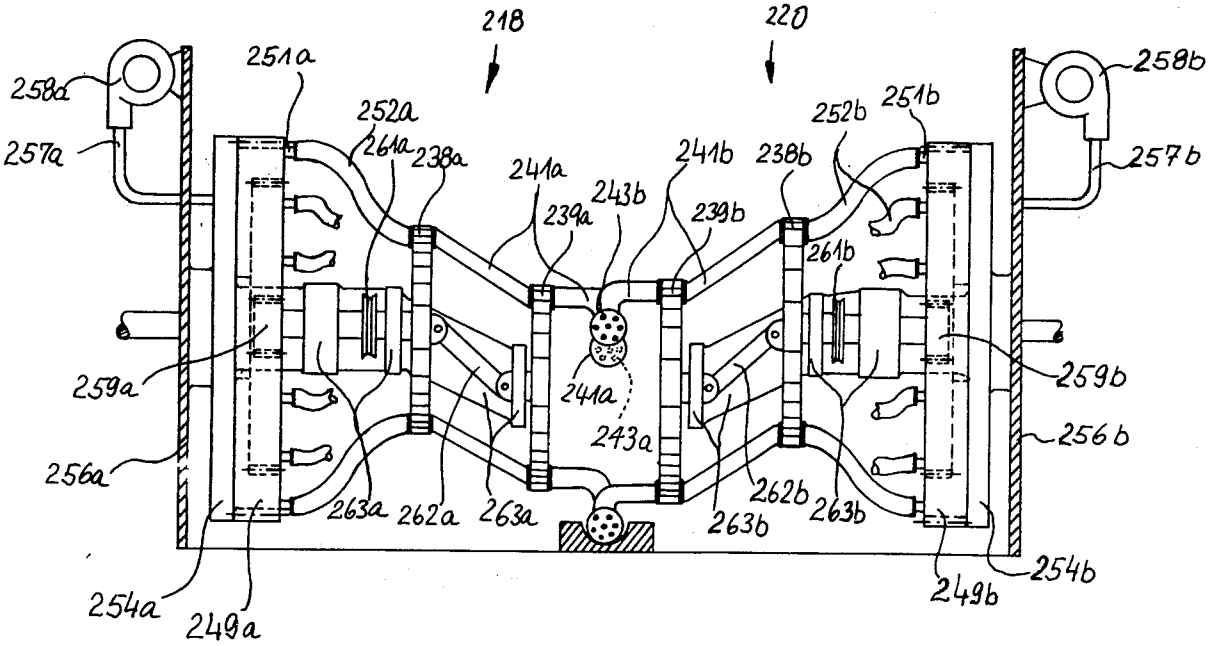
FIG. 9 is an end elevational view of the two conveyors as seen from the left-hand side of FIG. 8.

The details of the conveyors 218 and 220 are shown in FIGS. 8 and 9. The construction of the conveyor 218 is practically identical with that of the conveyor 220. Therefore, the parts of the conveyors 218, 220 are denoted by identical reference numerals but the numerals denoting the parts of the conveyors 218 and 220 are respectively followed by letters *a* and *b*. As shown in FIGS. 8 and 9, the conveyor 218 is mirror symmetrical to the conveyor 220 with reference to a plane which is normal to the upper stretch of the garniture belt 231 and extends midway between its marginal portions. The inserting conveyor 218 comprises two endless chains 238*a* and 239*a* which are located in parallel vertical planes at one side of the garniture belt 231 and serve to support and guide a series of discrete holders 241*a* for filter disks 242. The holders 241*a* have preferably rounded suction heads 241*a'* provided with suction ports 243*a* (FIG. 9) to hold one side of the respective filter disks 242 so that a disk 242 which is held by the head 241*a'* of its holder 241*a* can move sideways and toward the adhesive-coated upper side of the web 213 on the upper stretch of the garniture belt 231. The holders 241*b* of the conveyor 220 constitute displacing or shifting elements which can move filter plugs 210 axially relative to the upper side of the web 213 on the upper stretch of the belt 231; such axial movements of filter plugs 210 relative to the adhesive layer or layers on the web 213 take place before the adhesive is allowed to set. The suction ports 243*a* of the holders 241*a* are provided in those surfaces of the heads 241*a'* which face counter to the direction of movement of the web 213 on the belt 231, i.e., in a direction to the right, as viewed in FIG. 8 or away from the observer of FIG. 9. The suction ports 243*b* of the displacing elements 241*b* are provided in the front sides of such elements so that they can attract the trailing ends of the respective filter plugs 210 of double unit length.

Each holder 241*a* is a hollow tubular body which is turnable relative to the chains 238*a,* 239*a* and these chains are respectively trained over sprocket wheels 244*a,* 246*a* and 247*a,* 248*a.* The inserting conveyor 218 further comprises a hollow rotary suction drum 249*a* which is connected with the holders 241*a* by discrete flexible hoses 252*a.* Each hose 252*a* is preferably detachably but sealingly connected with a rotary nipple 251*a* of the suction drum 249*a.*

The suction drum 249*a* is provided with an annulus of external gear teeth meshing with a driver gear 253*a* which receives torque from the main prime mover (not shown) of the machine, and with an annulus of internal gear teeth meshing with a pinion 259*a* serving to drive the chains 238*a,* 239*a.* The outer end face of the suction drum 249*a* is adjacent to a stationary valve plate 254*a* having one or more arcuate grooves (not shown) in communication with certain axially parallel bores (not shown) of the drum 249*a* to thereby connect selected nipples 251*a* and the corresponding hoses 252*a* and holders 241*a* with a suction generating device 258*a* by way of a conduit 257*a.* The valve plate 254*a* is supported by a wall 256*a* of the machine frame.

The pinion 259*a* drives the sprocket wheel 244*a* by way of a V-belt transmission 261*a,* and the sprocket wheel 244*a* drives the sprocket wheel 247*a* through the intermediary of a Cardan shaft 262*a.* The suction wheel 249*a,* the moving parts of the transmission 261*a,* the shaft 262*a* and the sprocket wheels 244*a,* 246*a,* 247*a* and 248*a* are mounted on a bearing member or block 263*a* which is rigid with the wall 256*a.*

The diameters of the sprocket wheels 244*b,* 246*b,* 247*b,* 248*b* for the chains 238*b,* 239*b* of the displacing or shifting conveyor 220 exceed the diameters of similarly numbered sprocket wheels for the chains 238*a,* 239*a.* Thus, the chains 238*b,* 239*b* are somewhat longer than the chains 238*a,* 239*a.* Since the RPM of the sprocket wheels 244*a,* 247a equals the RPM of the sprocket wheels 244*b,* 247*b,* the displacing elements 241*b* move relative to the holders 241*a* when the chains 238*a,* 239*a* and 238*b,* 239*b* are in motion.

The operation of the machine shown in FIGS. 7 to 9 is as follows:

The outlet of the magazine 202 in the feeding unt 201 delivers filter rod sections of six times unit length into successive flutes of the continuously driven drum-shaped cutting conveyor 203 which cooperates with the aforementioned disk-shaped knives to subdivide each filter rod section into a set of three coaxial filter plugs 210 of double unit length. Each of the three staggering conveyors 204 receives a filter plug 10 of each set and moves the thus obtained plug at such a speed and/or through such a distance that the originally aligned plugs are staggered sideways and enter successive flutes of the aligning conveyor 206. The latter cooperates with two cams (not shown) which move the filter plugs 210 delivered by the left-hand and right-hand staggering conveyors 204 of FIG. 7 into register with plugs 210 which are delivered by the central staggering conveyor 204 so that the plugs 210 form a single row and move sideways onto the transfer conveyor 207 and thereupon into the range of successive pushers 209 on the conveyor belt 208. The distance between successive pushers 209 exceeds the combined length of a filter plug 210 and a filter disk 242 so that the lower stretch of the foraminous conveyor belt 211 receives and transports a single file of spaced-apart coaxial filter plugs 210 which are delivered onto the adhesive-coated upper side of the web 213 on the continuously moving upper stretch of the garniture belt 231. The applicator 216*a* of the paster 216 may coat parallel strips of or the entire underside of the web 213 (this underside is the upper side when the web 213 reaches and moves with the belt 231). It normally suffices if the web 213 is provided with two or more parallel strips of adhesive at least one of which serves to attract and hold the alternatingly delivered filter plugs 210 and filter disks 242. As mentioned before, the holding action of adhesive should not prevent axial displacement of the filter plugs 210 relative to the moving web 213 by means of shifting devices 241*b.*

The takeup reel 223 is driven at a contant speed to draw the strip 221 of filter material from the roll 222. The stamping tools of the continuously driven carrier 224 remove from the strip 221 a series of identical filter disks 242 which are taken over by the suction heads 241*a'* of successive holders 241*a.* The peripheral speed of the carrier 224 and counterknife 226 equals the speed of the strip 221. The diameter of each filter disk 242 equals or at least very closely approximates the diameter of a filter plug 210. The heads 241*a'* engage and attract by suction the adjacent end faces of the respective filter disks 242 and are oriented in such a way that the exposed second end faces are turned rearwardly, i.e., toward the holder 224, as viewed in FIG. 7.

The driver gears 253*a,* 253*b* rotate the suction drums 249*a,* 249*b* of the conveyors 218, 220 at a constant speed. The pinions 259*a,* 259*b* respectively drive the chains 238*a,* 239*a* and 239*b,* 239*b* to thereby move the holders 241*a* at a lower first speed and the shifting devices 241*b* at a higher second speed. This is due to the face that the diameters of the sprocket wheels 244*a,* 246*a,* 247*a,* 248*a* are smaller than the diameters of the sprocket wheels for the chains 238*b,* 239*b.* Due to their specific mounting and configuration, the holders 241*a* introduce filter disks 242 sideways into the spaces between successive filter plugs 110 on the upper side of the web 213. Such introduction of disks 242 takes place while the holders 241*a* travel around the rear sprocket wheels 246*a,* 248*a.* At the same time, successive shifting devices 241*b* are caused to enter the spaces behind successive filter plugs 210 on the web 213. The thus inserted suction heads of the shifting devices 241b thereupon move forwardly toward the preceding plugs 210 and their ports 243b are connected with the suction generating device 258b (by way of conduit 257b, valve plate 254b, suction drum 249b, nipples 251b and hoses 252b) as soon as the devices 241b come into actual contact with the adjacent filter plugs 210. The ports 243a of the suction heads 241a' of holders 241a are disconnected (by valve plate 254a and suction drum 249a) from the suction generating device 258a as soon as the shifting devices 241b advance the filter plugs 210 into contact with the rear end faces of the preceding filter disks 242. Such filter disks are then attracted to the filter plugs 210 behind them by suction which is produced by the device 258b and is effective in the respective ports 243b.

The length of the conveyors 218, 220 can be selected in such a way that the suction heads of holders 241a and shifting devices 241b continue to remain between the filter plugs 210 and filter disks 242 during the initial stage of conversion of the web 213 into a tube which surrounds the elements 210, 242 of the filter rod 228. This is shown in the lower part of FIG. 9.

The draping of the web 213 around alternating filter plugs 210 and filter disks 242 is completed in the mechanism 227 and the seam of the thus obtained tube is heated and stabilized by the sealer 232 before the rod 228 is severed by the orbiting knife of the cutoff 229 to yield a single file of filter mouthpieces 234 which are propelled into the flutes of the transfer conveyor 236 for delivery to the upper stretch of the conveyor belt 237.

The withdrawal of holders 241a and shifting devices 241b from the spaces between the disks 242 and plugs 210 takes place while the holders 241a and devices 241b respectively travel about the front sprocket wheels 244a, 246a and 244b, 246b. The ports 243b of suction heads on the shifting devices 241b are preferably disconnected from the suction generating means 258b immediately prior to withdrawal of devices 241b from behind the adjoining filter plugs 210.

It will be noted that the transfer conveyor 226 converts the single file of mouthpieces 234 which are formed by the cutoff 229 into one or more rows of mouthpieces which travel sideways.

The holders 241a and their suction heads constitute a very simple and effective means for manipulating the filter disks 242 during introduction into the spaces between the filter plugs 210 at the upper side of the web 213. It was found that the manipulation of filter disks 236 by purely mechanical means (e.g., grippers, tongs or the like) is very difficult or plain impossible, especially if the machine is to turn out a large number of filter mouthpieces per unit of time. The holders 241a can treat successive disks 242 gently without any or without appreciable deformation and can position the disks with a high degree of accuracy.

The machine of FIGS. 7–9 can be readily modified by using the shifting devices 241b as a means for holding and displacing the disks 242. Thus, instead of pushing the filter plugs 210 forwardly against the adjacent filter disks 242, the machine can be designed to push the filter disks forwardly toward the adjacent filter plugs 210. The feature that the filter disks 242 are held by suction heads 241a' at least prior to start of the draping operation in the mechanism 227 insures that the disks cannot be tilted or otherwise displaced prior to conversion of the web 213 into a tube which thereupon holds the disks and the plugs against movement relative to each other.

As mentioned before, at least a portion of the upper side of the web 213 on the upper stretch of the garniture belt 231 is coated with adhesive which bonds the tube to the filter elements 210 and 242.

Figure 11:
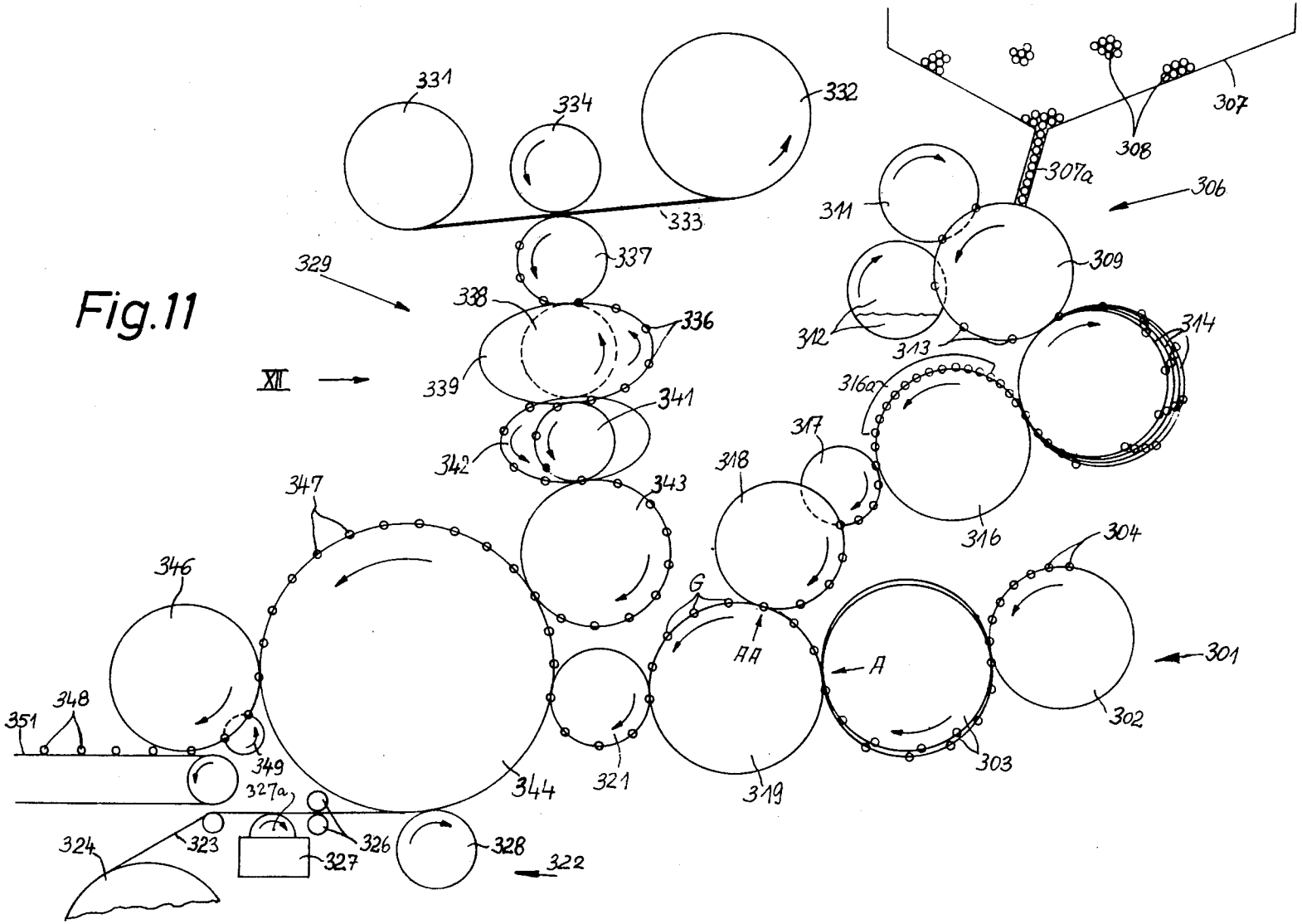
FIG. 11 is a schematic side elevational view of a filter cigarette making machine which embodies a third filter mouthpiece making machine.

Referring now to FIG. 11, there is shown a filter cigarette making machine which comprises a first feeding unit 301, a second feeding unit 306, a third feeding unit 322 and a fourth feeding unit 329. The feeding unit 301 comprises a transfer conveyor 302 which is a rotary drum (similar to the transfer conveyor 236 of FIG. 7) having axially parallel peripheral flutes for reception of discrete plain cigarettes 304 of unit length. The transfer conveyor 302 receives such cigarettes from a cigarette rod making machine which is not shown in FIG. 11. The machine which delivers plain cigarettes 304 to the transfer conveyor 302 can be of the type known as GARANT produced by the West-German firm Hauni-Werke of Hamburg-Bergedorf. The cigarettes 304 on the transfer conveyor 302 form two rows one of which includes the first, third, etc. cigarettes and is adjacent to one axial end of the conveyor 302. The other row includes the second, fourth, etc. cigarettes 304 and is adjacent to the other axial end of the conveyor 302.

The transfer conveyor 302 rotates continuously in the direction indicated by arrow and delivers successive plain cigarettes 304 of the two rows into the flutes of two aligning conveyors 303 which are rotated in a clockwise direction, as viewed in FIG. 11. The conveyors 303 are two discrete drums which transport the cigarettes 304 of the respective rows in such a way that when reaching a transfer station A, successive plain cigarettes 304 in the flutes of one of the conveyors 303 are in axial alignment with successive plain cigarettes 304 in the flutes of the other conveyor 303. At the transfer station A, the thus obtained pairs of aligned plain cigarettes 304 are transferred into successive flutes of an assembly conveyor 319 which is driven to rotate in a counterclockwise direction, as viewed in FIG. 11. The distance between the plain cigarettes 304 of pairs of coaxial cigarettes in the flutes of the assembly conveyor 319 exceeds the axial length of a filter plug 313 of double unit length.

The second feeding unit 306 comprises a magazine or hopper 307 which stores a substantial supply of parallel filter rod sections 308 of eight times unit length. The magazine 307 has an inclined duct or chute 307a which can accommodate a stack of parallel filter rod sections 308 and delivers such sections into successive flutes of a rotary cutting conveyor 309. The conveyor 309 transports successive filter rod sections 308 past a first rotary disk-shaped knife 311 which subdivides each filter rod section into two filter rod sections of four times unit length. The thus obtained filter rod sections of four times unit length are thereupon transported past two coaxial rotary disk-shaped knives 312 which subdivide the filter rod sections of four times unit length into pairs of coaxial filter plugs 313 of double unit length. The filter plugs 313 are thereupon transferred onto four staggering conveyors 314 which transport the respective plugs 313 through distances of different length and/or at different speeds so as to stagger the filter plugs circumferentially in a manner as shown in FIG. 11. The thus staggered filter plugs 313 are transferred into successive flutes of an aligning conveyor 316 which cooperates with cams 316a in order to move at least some of the plugs 313 axially and to form a single row of plugs which are located exactly one behind the other and travel sideways toward a transfer conveyor 317.

The latter transfers the plugs 113 of the single row into successive flutes of an accelerating conveyor 318 which transfers successive plugs 313 into successive flutes of the assembly conveyor 319. The station where the filter plugs 313 are introduced into successive flutes of the conveyor 319 is shown at AA. The mounting of the accelerating conveyor 318 is such that each filter plug 313 is inserted into the gap or space between a pair of coaxial plain cigarettes 304. Thus, once a flute of the assembly conveyor 319 advances beyond the transfer station AA, it contains a group G of three coaxial rod-shaped articles including a centrally located filter plug 313 of double unit length and a pair of plain cigarettes 304 of unit length which are located at the opposite axial ends of the respective filter plug 313.

Figure 12:
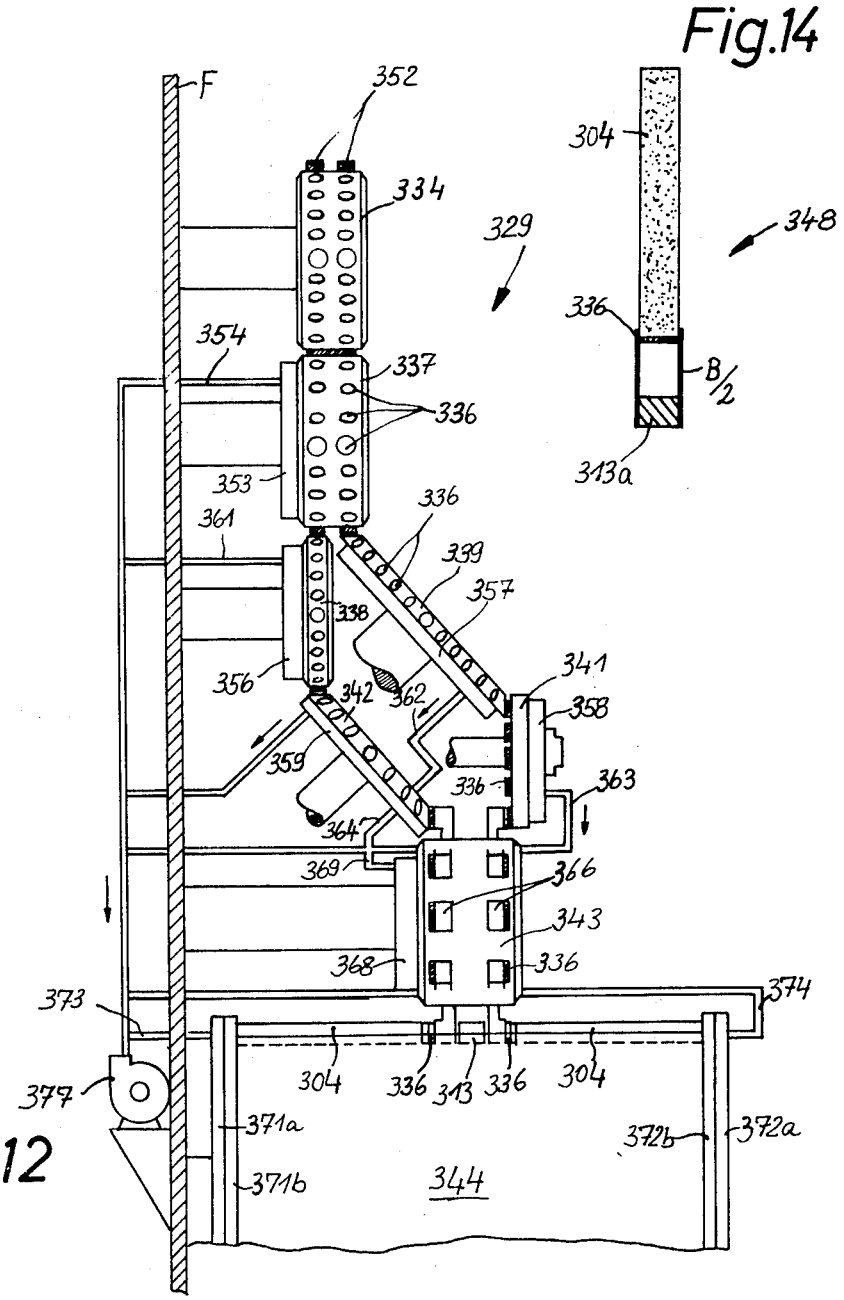
FIG. 12 is an enlarged side elevational view of a filter disk forming and feeding unit in the machine of FIG. 11, substantially as seen in the direction of arrow XII.
Figure 13:
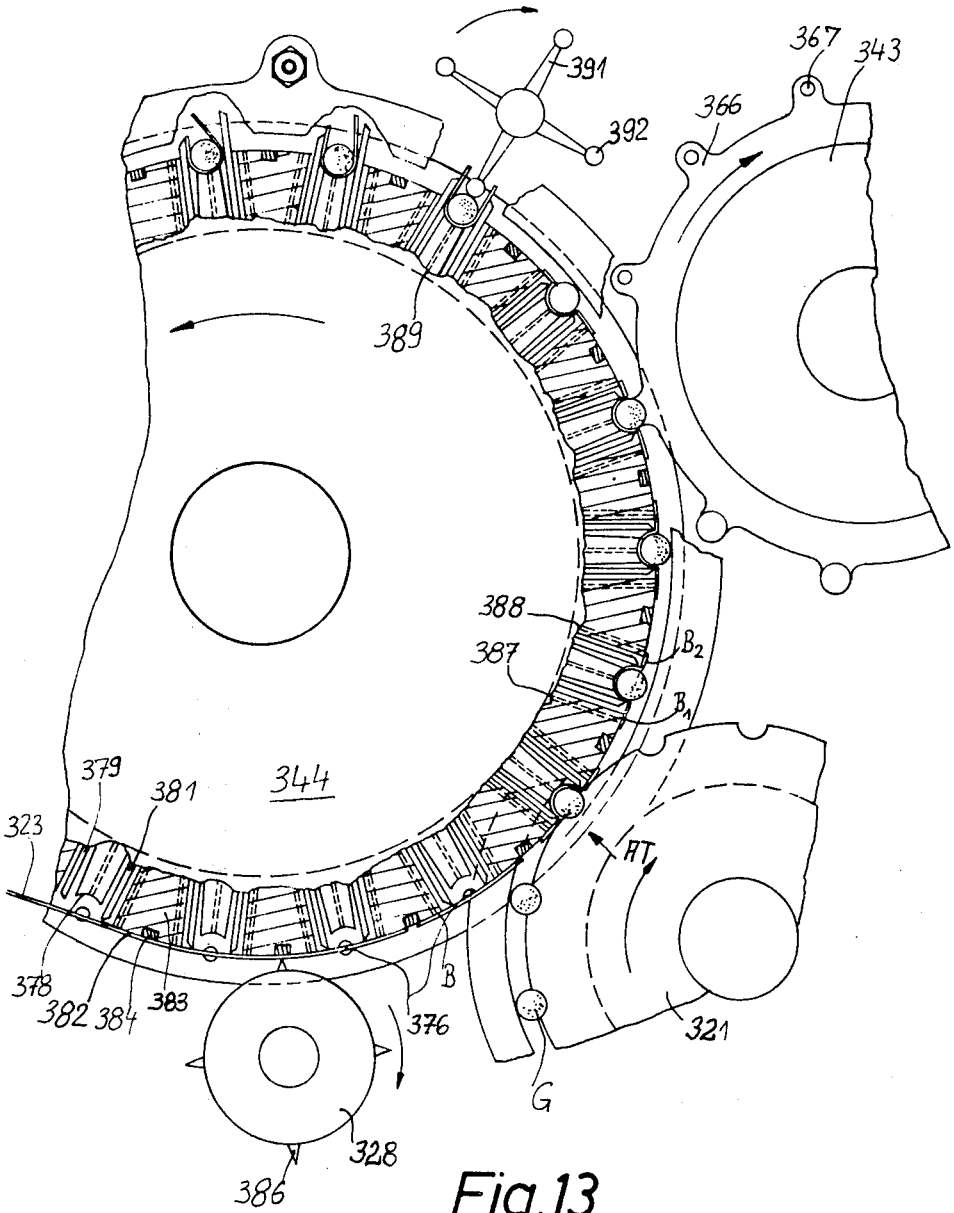
FIG. 13 is an enlarged transverse vertical sectional view of a wrapping conveyor in the machine of FIG. 11.

The assembly conveyor 319 delivers successive groups G into the flutes of a transfer conveyor 321 which delivers such groups to a wrapping conveyor 344 the details of which are illustrated in FIGS. 12 and 13.

The fourth feeding unit 329 comprises a roll or bobbin 331 of filter material 333 which can be converted into flat filter disks 336. The filter material 333 constitutes an elongated strip or tape which is collected by a continuously driven takeup reel 332 whereby an elongated portion of the material 333 travels in the space between the bobbin 331 and the reel 332. Such portion of the material 333 is acted upon by the stamping or punching tools 352 of a tool carrier 334 located opposite a transfer conveyor 337. The details of the feeding unit 329 are best shown in FIG. 12. It will be noted that the tool carrier 334 is a wheel which rotates in a counterclockwise direction, as viewed in FIG. 11, and is provided with two rows of stamping tools 352. The circular cutting edges of the tools 352 remove from successive increments of the material 333 disk-shaped filters 336 which are attracted by suction to the periphery of the transfer conveyor 337.

The tranfer conveyor 337 transports two discrete rows of filter disks 336 toward the peripheries of two first intermediate conveyors 338 and 339 best shown in FIG. 12. Each of the conveyors 338, 339 accepts the filter disks 336 of one row and respectively transfers such filter disks to a second intermediate conveyor 342, 341. The second intermediate conveyors 341, 342 deliver the filter disks 336 to a transfer conveyor 343 which, in turn, delivers the filter disks 336 to the wrapping conveyor 344.

The third feeding unit 322 of the filter cigarette making machine shown in FIG. 11 comprises a supply 324 of convoluted paper web 323 which is withdrawn by a pair of cooperating advancing rolls 326. The underside of the web 323 is coated with a suitable adhesive during travel past the rotary applicator 327*a* of a conventional paster 327. The thus coated leading end of the strip 323 is severed by a rotary knife 328 which is provided with equidistant blades 386 (see FIG. 13) serving to subdivide the strip 323 into discrete uniting bands B also shown in FIG. 13. Such bands are convoluted around the groups G on the wrapping conveyor 344 subsequent to introduction of a filter disk 336 into the gap between a filter plug 313 and the adjacent end of a plain cigarette 304. It will be noted (see the lower portion of FIG. 12) that each group G receives two filter disks 336 prior to convolution of a uniting band B therearound. The convoluted bands B form tubes which convert the respective groups G into filter cigarettes 347 of double unit length. Such filter cigarettes are thereupon transferred onto a cutting conveyor 346 which has axially parallel flutes and transports the cigarettes 347 past a rotary disk-shaped knife 349 serving to subdivide each filter cigarette 347 into a pair of filter cigarettes 348 of unit length. The knife 349 severs the cigarettes 347 midway between their ends and halfway across the respective composite filter mouthpieces of double unit length. The pairs of filter cigarettes 348 of unit length are transferred onto the upper stretch of a conveyor belt 351 which transports the cigarettes 348 to storage, to a tray filling apparatus or directly into a packing machine, not shown.

FIG. 14 shows in axial section one complete filter cigarette 348 of unit length. It will be seen that this cigarette comprises a plain cigarette 304 of unit length, a filter disk 336 which is immediately adjacent to one axial end of the plain cigarette 304, a filter plug 313*a* of unit length which is axially spaced from the disk 336, and one half B/2 of a convoluted uniting band B.

Referring to FIG. 12, the conveyors of the feeding unit 329 are mounted in a frame F so that the filter disks 336 are transported downwardly from the carrier 334 toward the wrapping conveyor 344. The carrier 334 is rotated at a constant speed and is provided with internally mounted helical or otherwise configurated springs (not shown) which bias the stamping tools 352 radially outwardly. Each tool 352 is a tubular metallic body the outer end of which is provided with a circumferentially complete cutting edge which separates from the strip of filter material 333 a disk 336 during travel past the transfer conveyor 337. The latter constitutes a counterknife which is provided with a cylindrical peripheral surface consisting of hard metal and formed with a large number of suction ports (not shown) which attract the freshly separated filter disks 336 to the transfer conveyor 337 during transport toward the first intermediate conveyors 338 and 339. One axial end of the transfer conveyor 337 is adjacent to a stationary valve plate 353 which is provided with one or more suitably configurated arcuate grooves connected with a suction generating device 377 (e.g., a fan) by way of a conduit 354. The groove or grooves in the right-hand end face of the valve plate 353 communicate with the suction ports of the transfer conveyor 337 while such ports travel between the station where the filter disks 336 are being stamped and the station where the filter disks 336 are being transferred onto the intermediate conveyors 338 and 339.

The intermediate conveyor 338 is a cylinder one end face of which rotates adjacent to a stationary valve plate 356 having one or more arcuate suction grooves (not shown) connected with the suction generating device 377 by a conduit 361. The cylindrical peripheral surface of the intermediate conveyor 338 is provided with a large number of preferably small suction ports (not shown) which communicate with the groove or grooves of the valve plate 356 during transport of filter disks 336 from the transfer conveyor 337 to the intermediate conveyor 342. The intermediate conveyor 339 is a frustum of a cone and its conical peripheral surface is provided with suction ports (not shown) which communicate during a certain stage of their travel about the axis of the conveyor 339 with one or more grooves (not shown) provided in a stationary valve plate 357 adjacent to the base of the conveyor 339. The groove or grooves of the valve plate 357 are connected with the suction generating device 377 by a conduit 362. The ports of the intermediate conveyor 339 attract the filter disks 336 during transport of such disks from the cylindrical peripheral surface of the transfer conveyor 337 to the intermediate conveyor 341. The intermediate conveyor 342 is a cone similar to the conveyor 339 and is provided in its conical peripheral surface with suction ports (not shown) communicating during a certain stage of their orbital movement with one or more arcuate grooves provided in the right-hand end face of a stationary valve plate 359. The groove or grooves of the valve plate 359 communicate with the suction generating device 377 by way of a conduit 364. The intermediate conveyor 341 is a short cylinder one end face of which is provided with an annulus of suction ports (not shown). The other end face of the intermediate conveyor 341 rotates relative to a stationary valve plate 358 having one or more arcuate suction grooves (not shown) which are connected with the suction generating device 377 by way of a conduit 363. The ports of the conveyor 341 communicate with the groove or grooves of the valve plate 358 during transport of filter disks 336 from the conical peripheral surface of the intermediate conveyor 339 to the transfer conveyor 343.

The transfer conveyor 343 is provided with two rows of holders 366 having suction heads which can retain the filter disks 336 in such positions that the planes of the filter disks on the suction heads of holders 366 are located at right angles to the axis of rotation of the conveyor 343. The right-hand end faces of the suction heads on holders 366 which are adjacent to the right-hand axial end of the transfer conveyor 343, as viewed in FIG. 12, are provided with suction ports 367 (see FIG. 13) which can attract the filter disks 336 during transport from the intermediate conveyor 341 into successive flutes of the wrapping conveyor 344. Analogously, the left-hand end faces of the suction heads on the left-hand row of holders 366, as viewed in FIG. 12, are provided with suction ports which attract filter disks 336 during transport from the intermediate conveyor 342 into successive flutes of the wrapping conveyor 344. The left-hand end face of the transfer conveyor 343 rotates relative to a stationary valve plate 368 having in its right-hand end face one or more arcuate grooves (not shown) connected to the suction generating device 377 by a conduit 369. The groove or grooves of the valve plate 368 communicate with the ports 367 of suction heads of holders 366 while such suction heads transport filter disks 336 to the wrapping conveyor 344.

The wrapping conveyor 44 is flanked by two stationary valve plates 371*a,* 372*a* which are outwardly adjacent to rotary retaining or stop rings 371*b,* 372*b,* respectively. The valve plates 371*a,* 372*a* are respectively connected with the suction generating device 377 by conduits 373, 374. Each of these valve plates is provided with a suction groove (not shown) which can attract the adjacent plain cigarettes 304 in the flutes of the wrapping conveyor 344. The rings 371*b,* 372*b* have suction ports or bores 376 which connect the grooves of the valve plates 371*a,* 372*a* with the flutes 378 for plain cigarettes 304 in the wrapping conveyor 344. The bores or ports 376 of the ring 371*b* are shown in FIG. 13.

The details of the wrapping conveyor 344 are illustrated in FIG. 13. This conveyor is of the type disclosed, for example, in German Pat. Nos. 1,157,525 and 1,182,123. Each receiving means or flute 378 extends in parallelism with the axis of rotation of the conveyor 344. This conveyor has a cylindrical body which is provided with pairs of radially extending cutouts for cooperating rolling or wrapping plate 379, 381. Each pair of rolling plates 379, 381 flank a flute 378. As disclosed in the aforementioned German patents, the rolling plates 379, 381 can be moved together with as well as relative to each other in the radial direction of the wrapping conveyor 344 to thereby effect a controlled wrapping of uniting bands B around the groups G in the respective flutes 378. The rolling plates 379, 381 are mounted in the central portion of the cylindrical body of the conveyor 344 and are wide enough to be capable of convoluting the entire uniting bands B in the respective flutes 378. When the rolling plates 379, 381 are fully retracted into the cylindrical body of the conveyor 344, they do not project outwardly beyond the lands 382 which extend between neighboring flutes 378. The lands 382 are provided on the cylinder portions 383 of the conveyor 344 and form an interrupted peripheral surface which supports the uniting bands B. As shown in FIG. 13, the bands B are formed by the blades 386 of the rotary knife 328 which cooperates with the lands 382 to sever the paper web 323 at regular intervals. It will be recalled that the outer side of the paper web 323 (as viewed in FIG. 13) has been coated with adhesive during travel past the applicator 327*a* of the paster 327 shown in FIG. 11. The portions 383 of the cylindrical body of the conveyor 344 together form a hollow drum which transports the uniting bands B in a counterclockwise direction, as viewed in FIG. 13. In order to reduce the wear on the lands 382, the portions 383 are preferably provided with axially parallel recesses for reception of relatively hard metallic inserts 384 which serve as counterknives and cooperate with the edges of blades 386 to form clean cuts in the web 323 whereby the leading end of the web yields a succession of uniting bands B.

FIG. 13 further shows that the conveyor portions 383 are provided with radially extending suction ports 387 and 388 which are adjacent to the neighboring rolling plates 379 and 381. The purpose of suction ports 387, 388 is to attract the respective ends of uniting bands B during certain stages of conversion of such bands into tubes of the filter cigarettes 347 of double unit length. Those ends of the uniting bands B which are respectively attracted by the suction ports 387, 388 are shown in FIG. 13, as at B1 and B2. The flutes 378 are also provided with suction ports, shown at 389, which serve to attract certain components of the groups G during conversion of such groups into filter cigarettes 347 of double unit length. The suction ports 389 form in each flute 378 a row which extends in the axial direction of the conveyor 344 so that the ports 389 can attract the two plain cigarettes 304 and the filter plug 313 of the respective group G. The machine of FIG. 11 further comprises a star-shaped rotary pressing member 391 which is shown in the upper portion of FIG. 13 and has four equidistant prongs provided with rounded outer end portions 392 serving to press successive groups G into the respective flutes 378 during certain stages of the wrapping operation.

The operation of the machine of FIGS. 1 to 13 is as follows:

The transfer conveyor 302 of the feeding unit 301 receives two rows of plain cigarettes 304 of unit length from a cigarette rod making machine (now shown) in such a way that each of its flutes contains a single cigarette 304 and that the cigarettes in successive flutes are staggered with respect to each other. The cigarettes of one row are transferred onto one of the aligning conveyors 303 and the cigarettes of the other row are transferred onto the other aligning conveyor 303. The function of the conveyors 303 is just the opposite of that of conveyors 204 shown in FIG. 7, i.e., the front conveyor 303 of FIG. 11 moves its foremost cigarette 304 into axial alignment with the foremost cigarette 304 on the rear aligning conveyor 303 at the exact moment when such cigarettes reach the station A to be transferred into successive flutes of the assembly conveyor 319. The axially aligned cigarettes 304 in the flutes of the assembly conveyor 319 are spaced apart to provide room for filter plugs 313 and for pairs of filter disks 336.

The duct 307*a* of the magazine 307 delivers filter rod sections 308 of eight times unit length into successive flutes of the cutting conveyor 309 which cooperates with the knife 311 and knives 312 to subdivide each section 308 into a set of four coaxial filter plugs 313 of double unit length. The flutes of the four conveyors 314 receive one filter plug 313 of each set and move the filter plugs sideways with as well as relative to each other so that the filter plugs 313 are staggered in the circumferential direction of conveyors 314 and can be delivered into successive flutes of the aligning conveyor 316. The latter cooperates with the cams 316*a* to move at least three of each original set of four filter plugs axially so as to convert the filter plugs into a single row with each filter plug located exactly behind the preceding filter plugs. The filter plugs 313 of the thus obtained row are transferred into successive flutes of the transfer conveyor 317 and are taken over by the accelerating conveyor 318 which delivers them into spaces between pairs of coaxial plain cigarettes 304 in successive flutes of the assembly conveyor 319. The insertion of filter plugs 313 takes place at the station AA. The thus obtained groups G are moved sideways and are introduced into successive flutes of the transfer conveyor 321 which delivers them into successive receiving means or flutes 378 of the wrapping or rolling conveyor 344.

The assembly conveyor 319 or the transfer conveyor 321 preferably cooperates with suitable cams (similar to the cams 316*a*) to move successive pairs of coaxial plain cigarettes 304 toward each other so as to provide between the filter plug 313 and the plain cigarettes 304 of each group G two spaces or gaps of predetermined width as shown in the lower portion of FIG. 12.

The advancing rolls 326 of the feeding unit 322 draw the paper web 323 from the roll 324 and move the underside of the web along the rotating applicator 327*a* of the paster 327. The leading end of the thus coated web 323 is attracted to the lands 382 of the wrapping conveyor 344 by suction ports 387, 388 and is severed by the blades 386 of the continuously rotating knife 328 so as to yield a series of adhesive-coated uniting bands B which continue to adhere to the periphery of the conveyor 344. As shown in FIG. 13, the front and rear ends B2 and B1 of successive uniting bands B are attracted by the adjoining suction ports 388, 387 so that the median portion of each band B overlies the respective flute 378. The transfer conveyor 321 delivers groups G into successive flutes 378 at the transfer station AT shown in FIG. 13 and presses such groups into the respective flutes with attendant deformation of uniting bands B; however, the leading and trailing ends B2, B1 of such uniting bands continue to overlie and are attracted by the adjacent ports 388, 387. The ends B2, B1 slip along the respective lands 382 during forcible insertion of groups G into the respective flutes 378 but the suction ports 387, 388 are drilled into the cylindrical body of the conveyor 344 in such positions that they are also capable of attracting the ends of the bands B downstream of the transfer station AT.

The continuously driven takeup reel 332 of the feeding unit 329 draws the strip 33 of filter material off the roll 331 and the continuously rotating carrier 334 causes its tools 352 to remove from the strip 333 two rows of filter disks 336 which are attracted by the transfer conveyor 337 (see FIG. 12) and delivered to the intermediate conveyors 338, 339. The conveyors 338, 339 respectively deliver filter disks 336 to the intermediate conveyors 342, 341 and the conveyors 341, 342 deliver the filter disks to the suction heads of successive pairs of holders 366 on the transfer conveyor 343. As shown in FIG. 12, the suction head of each holder 366 attracts one end face of the respective filter disk 336 during transfer into the adjoining flute 378 of the wrapping conveyor 344. The holders 366 delier to each flute 378 a pair of coaxial filter disks 336 in such a way that each disk 336 enters one of the two spaces between the filter plug 313 and the respective plain cigarettes 304.

Suction in the boxes 376 is controlled by the valve plates 371*a*, 372*a* in such a way that, once the filter disks 336 are inserted into a flute 378, they are attracted to the inner ends of the adjacent plain cigarettes 304 by suction air streams which flow outwardly through such cigarettes and toward the rings 371*b*, 372*b*. The thus completed groups G thereupon advance past the pressing member 391 and are pressed into their flutes 378 by successive rounded end portions 392 while the respective rolling plates 379, 381 move outwardly to start the draping of uniting bands B around the adjacent filter plugs 313, pairs of filter disks 336 and the inner ends of the respective pairs of plain cigarettes 304. The plate 381 is thereupon moved radially inwardly while the plate 379 moves radially outwardly (see the upper portion of FIG. 13) with the result that the ends B2 of successive uniting bands B are completely convoluted around the adjacent portions of the respective groups G. In the next step, the plates 381 are moved outwardly while the plates 379 move inwardly in a manner not shown in FIG. 13 to complete the conversion of successive uniting bands B into tubes which sealingly connect the thus obtained mouthpieces of double unit length to the respective pairs of plain cigarettes 304. The resulting filter cigarettes 347 of double unit length are transferred onto the cutting conveyor 346 which cooperates with the rotary knife 349 to sever each cigarette 347 midway between its ends so that each cigarette 347 yields two filter cigarettes 348 of unit length. The cigarettes 348 are transferred onto the conveyor belt 351 for delivery to storage, to a tray filling apparatus or directly to a packing machine. One row of filter cigarettes 348 is preferably inverted end-for-end so that the filter mouthpieces of the inverted row of cigarettes 348 face in the same direction as the filter mouthpieces of the non-inverted cigarettes. As shown in FIG. 14, the filter disk 336 of the mouthpiece forming part of a filter cigarette 348 of unit length abuts against the concealed end of the plain cigarette 304. Such disk 336 cannnot move because it is bonded to the inner side of the tube B/2. The filter plug 313*a* of unit length is located at the free end of the respective tube B/2 and is separated from the filter disk 336 by a clearance or gap of predetermined width which, in the illustrated embodiment, exceeds the axial length of the plug 313*a*.

The placing of filter disks 336 into the spaces between the elements of the groups G on the wrapping conveyor 344 is desirable because, were the disks 336 placed onto the assembly conveyor 319, it would be difficult to hold them against tilting during transport to and through the wrapping station. By inserting the disks 336 shortly or immediately before the conversion of uniting bands B into tubes, it is possible to hold the disks 336 by suction on the heads of holders 366 of the transfer conveyor 343, a mode of holding which has been found to be best suited for proper transport of thin disk-shaped filter elements. The filter disks 336 are too thin to be properly retained by suction or by mechanical means during sidewise movement in a flute or the like. On the other hand, the retention of relatively long plain cigarettes or filter plugs in the flutes of a drum-shaped conveyor presents no problems.

The provision of holding means which engage one end face of each filter disk 242 or 336 renders it possible to assemble the improved filter mouthpieces in machines which embody many presently used components for reliable transport and manipulation of relatively long plain cigarettes, other tobacco rod sections and/or filter rod sections.

Once the filter disks 336 are inserted into the flutes 378 of the wrapping conveyor 344, they are attracted to the adjacent end faces of the respective plain cigarettes 304 by suction so that they cannot leave the flutes under the action of centrifugal force or gravity. The arrangement is such that the suction heads of holders 366 are disconnected from the suction generating device 377 not earlier than when the conduits 373, 374 begin to draw air through the plain cigarettes 304 in the flutes 378 so that the filter disks 336 are held by suction insertion into the flutes 378 as well as during conversion of the respective uniting bands B into tubes which unite the rod-shaped components 304, 336, 313, 336, 304 into filter cigarettes 347 of double unit length.

During smoking of a filter cigarette 348, the respective filter disk 336 (see FIG. 14) accumulates nicotine, tar and other harmful substances so that its volume increases. Such expansion of the filter disk 336 is desirable in order to insure that its filaments can intercept large quantities of deleterious ingredients of tobacco smoke. This explains the desirability of placing the filter plug 313*a* at a certain distance from the filter disk 336. In the absence of a clearance between the elements 313*a*, 336 of the mouthpiece shown in FIG. 14, the filter disk 336 would be likely to become clogged so that it could not absorb additional tar and/or nicotine.

An important advantage of the improved method and apparatus is that the filter mouthpieces with one or more filter disks therein can be manufactured with a high degree of reproducibility in spite of the sensitivity of relatively thin, soft and therefore readily deformable filter disks. Moreover, and since all feeding units and conveyors preferably operate continuously, the output of the machine is just as high as that of a machine for the making of conventional filter mouthpieces with readily manipulable filter plugs but without filter disks. The method and machine can be used for the making of filter mouthpieces of unit length or multiple unit length, for the making of discrete filter mouthpieces, or for the production of smokers' products which embody the improved mouthpieces.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

We claim:

1. A method of making composite filter mouthpieces, comprising the steps of moving a continuous web of wrapping material lengthwise; placing onto one side of the moving web a single file of axially spaced filter plugs and moving the filter plugs with the web; placing filter disks between successive plugs of said file, including individually holding each of the filter disks at one axial end thereof and positioning each of the thus held filter disks in abutment with one of the adjacent filter plugs, and moving the filter disks with the web and filter plugs; draping the web around the filter plugs and filter disks to form an elongated filter rod wherein filter plugs alternate with filter disks, including connecting said filter disks with the abutting filter plugs by means of said wrapping material; and severing the filter rod to form a plurality of discrete mouthpieces each of which contains at least one filter disk and at least a portion of at least two filter plugs.

2. A method as defined in claim 1, wherein said first placing step takes place at least substantially simultaneously with said second placing step.

3. A method as defined in claim 1, wherein each of said placing steps comprises moving the filter disks and the filter plugs sideways against said one side of the moving web.

4. A method as defined in claim 1, wherein said holding step comprises holding the filter disks by suction.

5. A method as defined in claim 1, wherein said positioning step comprises axially moving the filter disks between the neighboring filter plugs so that each of thus moved filter disks abuts against one of the adjacent filter plugs prior to said draping step.

6. A method as defined in claim 1, further comprising the step of axially moving the filter plugs of said file so that each thereof abuts against one of said filter disks prior to said draping step.

7. A method as defined in claim 1, further comprising the step of holding the filter disks in abutment with the respective filter plugs at least until the start of said draping step.

8. A method of making composite filter mouthpieces, comprising the steps of moving a continuous web of wrapping material lengthwise; placing onto one side of the moving web a single file of axially spaced filter plugs and moving the filter plugs with the web; placing filter disks between successive filter plugs of said file and moving the filter disks with the web and filter plugs; locating each filter disk in abutment with one of the neighboring filter plugs at said one side of the moving web; thereupon draping the web around the filter plugs and filter disks to form an elongated filter rod wherein filter plugs alternate with filter disks, said locating step including holding the filter disks in abutment with the respective filter plugs at least until the start of said draping step and said holding step including attracting filter disks to the abutting filter plugs by suction acting through the abutting filter plugs; and severing the filter rod to form a plurality of discrete mouthpieces each of which contains at least one filter disk and at least a portion of at least two filter plugs.

9. In a machine for producing composite filter mouthpieces of the type wherein a tubular wrapper surrounds at least one plug-shaped and at least disk-shaped filter element, a combination comprising first feeding means including a source of elongated web-shaped wrapping material and means for continuously moving the wrapping material lengthwise; second feeding means including a source of filter plugs and means for delivering a file of spaced-apart coaxial filter plugs onto the moving wrapping material; third feeding means including means for supplying at least one series of filter disks; inserting conveyor means having a plurality of holder means for introducing the filter disks furnished by said third feeding means between successive filter plugs on the moving wrapping material; displacing conveyor means having a plurality of devices for shifting the filter plugs axially relative to the moving wrapping material, each of said shifting devices comprising a suction head arranged to attract a filter plug; wrapping means for convoluting said material around the filter plugs and filter disks to form a continuous filter rod; and means for subdividing the rod into mouthpieces.

10. In a machine for producing composite filter mouthpieces of the type wherein a tubular wrapper surrounds at least one plug-shaped and at least one disk-shaped filter element, a combination comprising first feeding means including a source of elongated web-shaped wrapping material and means for continuously moving the wrapping material lengthwise; second feeding means including a source of filter plugs and means for delivering a file of spaced-apart coaxial filter plugs onto the moving wrapping material; third feeding means including means for supplying at least one series of filter disks; inserting conveyor means having a plurality of holder means for introducing the filter disks furnished by said third feeding means between successive filter plugs on the moving wrapping material; displacing conveyor means having a plurality of devices for shifting the filter plugs axially relative to the moving wrapping material and means for moving said shifting devices relative to said holder means so as to move each filter plug on the moving wrapping material into abutment with a filter disk; wrapping means for convoluting said material around the filter plugs and filter disks to form a continuous filter rod; and means for subdividing said rod into mouthpieces.

11. A combination as defined in claim 10, wherein said delivering means of said second feeding means comprises at least one continuously moving conveyor for filter plugs, said inserting conveyor means comprising at least one continuously moving conveyor for filter disks.

12. A combination as defined in claim 10, wherein said severing means comprises a cutoff arranged to sever each second filter plug in said rod midway between the axial ends of the filter plug so that each of said mouthpieces contains an unsevered filter plug, two filter disks and portions of two severed filter plugs.

13. A combination as defined in claim 10, wherein each of said holder portions is a suction head.

14. A combination as defined in claim 10, further comprising displacing conveyor means having a plurality of devices for shifting the filter plugs axially relative to the moving wrapping material.

* * * * *